US010328322B1

(12) United States Patent
King

(10) Patent No.: US 10,328,322 B1
(45) Date of Patent: Jun. 25, 2019

(54) PORTABLE BASKETBALL HOOP

(71) Applicant: King I LLC, Milwaukee, WI (US)

(72) Inventor: Robert B. King, Milwaukee, WI (US)

(73) Assignee: King I, LLC, Milwaukee, WI (US)

( * ) Notice: Subject to any disclaimer, the term of this patent is extended or adjusted under 35 U.S.C. 154(b) by 0 days.

(21) Appl. No.: 15/288,536

(22) Filed: Oct. 7, 2016

Related U.S. Application Data

(60) Provisional application No. 62/326,456, filed on Apr. 22, 2016.

(51) Int. Cl.
*A63B 63/00* (2006.01)
*A63B 63/08* (2006.01)
*A63B 71/00* (2006.01)

(52) U.S. Cl.
CPC ..... *A63B 63/083* (2013.01); *A63B 71/0036* (2013.01); *A63B 2063/002* (2013.01); *A63B 2210/50* (2013.01); *A63B 2243/0037* (2013.01)

(58) Field of Classification Search
CPC ..... A63B 63/083; A63B 71/0036; A63B 2063/002; A63B 2243/0037; A63B 2210/50
See application file for complete search history.

(56) References Cited

U.S. PATENT DOCUMENTS 4,793,611 A * 12/1988 Thornell ..... A63B 63/083 16/343
4,869,501 A 9/1989 Anastasakis
5,158,281 A * 10/1992 Williams ..... A63B 63/083 248/910
5,163,676 A 11/1992 Taub
5,377,976 A 1/1995 Matherne et al.
5,573,237 A 11/1996 Van Nimwegen et al.
6,412,736 B1 * 7/2002 Zaragoza ..... A63B 67/10 212/179
7,413,522 B2 8/2008 O'Neill et al.
7,946,936 B2 5/2011 Stanford et al.
2005/0255946 A1 11/2005 Liu
2007/0191148 A1 8/2007 Shannon
2007/0191150 A1 * 8/2007 Lu ..... A63B 63/083 473/479
2010/0078280 A1 4/2010 Mauro
2015/0148153 A1 * 5/2015 Sims ..... A63B 63/083 473/481

(Continued)

OTHER PUBLICATIONS http://www.masterlock.com/personal-use/product/265DCCSEN; Masterlock, Jan. 12, 2015, www.masterlock.com.*

*Primary Examiner* — Eugene L Kim
*Assistant Examiner* — Jeffrey S Vanderveen
(74) *Attorney, Agent, or Firm* — Boyle Fredrickson, S.C.

(57) ABSTRACT

A portable basketball hoop includes a base; a post comprising a bottom segment, at least one middle segment, and an upper segment. The base has a plurality of openings circumferentially positioned around at least a part the perimeter of the bottom surface. The bottom and at least one middle segment have a body portion with a plurality of locking structure-engaging areas thereby forming pairs of locking structure-engaging areas arranged in at least two rows locking structures engage the locking structure-engaging areas to secure the post segments together. A backboard comprising two outer sections hingedly connected to a middle section which secures to the upper segment of the post.

20 Claims, 30 Drawing Sheets

(56) References Cited

U.S. PATENT DOCUMENTS

| | | | | |
|---|---|---|---|---|
| 2015/0297967 | A1* | 10/2015 | Simon | A63B 69/0026 473/446 |
| 2016/0082330 | A1* | 3/2016 | Barnes | A63B 63/083 473/481 |

* cited by examiner

PORTABLE BASKETBALL HOOP

FIELD OF THE INVENTION

The present invention relates, generally, to the field of portable basketball hoops. More particularly, the present invention relates to basketball hoops which assemble and disassemble easily for quick portability.

BACKGROUND OF THE INVENTION

Basketball is a popular sport, especially for young children, teens and young adults. Typically, basketball must be played on a court, such as in a gym or at a park. Other basketball hoops may be attached to a structure such as a garage or otherwise assembled on a person's property to move basketball play to more convenient locations or for playing at any time of day.

Generally, current portable basketball hoops are cumbersome and difficult to transport and/or assemble. For example, some known portable basketball stands disassemble into components of somewhat manageable size, but the pieces are not easily stored. Other portable basketball hoops collapse and/or disassemble into organized pieces which facilitate storage, but the size and weight of system make them inconvenient to transport.

Furthermore, most portable basketball systems require a means for weighing down the post to which the hoop is attached to prevent the basketball hoop from tipping over. Known weight systems require water or sand to fill a base. This is inconvenient because a player must then either transport an amount of water or sand to fill the base or rely on water or sand being available at the final destination. Other portable basketball systems use weights which sit on or around the post, or otherwise fit in a base component, but the size and weight of such weight systems render them inconvenient to store and transport.

For at least these reasons, therefore, it would be advantageous if a new or improved portable basketball hoop could be developed that addressed one or more of the above-described concerns, and/or other concerns.

SUMMARY OF THE INVENTION

In accordance with one embodiment, disclosed herein is a portable basketball hoop.

In accordance with a further embodiment, disclosed herein is a portable basketball hoop comprising: a base having a bottom surface with a perimeter, a plurality of openings circumferentially positioned around at least a portion of the perimeter, and an upper surface with an opening; a post comprising a bottom segment having a bottom portion which engages the base at the opening of the upper surface, and a body portion comprising a plurality of locking structure-engaging areas arranged in at least two rows, wherein each of the rows includes the same number of locking structure-engaging areas and each locking structure-engaging area in one of the at least two rows has a corresponding locking structure-engaging area the second of the at least two rows, thereby forming a plurality of pairs of locking structure-engaging areas wherein the locking structure-engaging areas of a given pair are at the same height, at least one middle segment having a body portion comprising a plurality of locking structure-engaging areas arranged in at least two rows, wherein each of the rows includes the same number of locking structure-engaging areas and each locking structure-engaging area in one of the at least two rows has a corresponding locking structure-engaging area of the second of the at least two rows, thereby forming a plurality of pairs of locking structure-engaging areas wherein the locking structure-engaging areas of a given pair are at the same height, an upper segment having an upper portion having a back plate, wherein the back plate includes at least one securing structure, and at least two locking structures, each locking structure corresponding to one of the pairs of locking structure-engaging areas of the bottom segment and the at least one middle segment; a backboard comprising two outer sections hingedly connected to a middle section, wherein the middle section includes at least one attachment point corresponding to the at least one securing structure of the back plate; and a rim comprising at least one attachment point corresponding at least one of (i) the at least one attachment point of the middle section of the backboard, and (ii) the at least one securing structure of the back plate.

In accordance with a further embodiment, disclosed herein is a portable basketball hoop system comprising: a portable basketball hoop comprising a post comprising at least three releasably connected segments, a base configured to receive at least one weight and secure the post; a backboard having a front surface and a back surface, the backboard comprising a first outer section, a second outer section and a middle section, wherein the first outer section is connected to the middle section at a first hinged seam and the second outer section is connected to the middle section at a second hinged seam, wherein the first and second outer sections are configured to hingedly pivot from an open position to a folded position, wherein the front surface of each of the first outer section, second outer section and middle section is approximately coplanar when in the open position, wherein the front surface of the first outer section faces the front surface of the middle section and the back surface of the second outer section faces the back surface of the middle section when in the folded position, wherein the middle section is configured to secure to the post, and a rim configured to secure to the backboard; at least one weight; wherein the portable basketball hoop is configured to be stored in a travel case.

In accordance with a further embodiment, disclosed herein is a method of assembling a portable basketball hoop comprising: providing a base, at least three post segments, a backboard and a rim, wherein a first and second of the at least three post segments each comprise a body portion with a plurality of openings arranged in at least two rows, wherein each row has the same number of openings and the openings in a first row each have a corresponding opening in the second row such that the corresponding openings are at the same height, and wherein the second and a third of the at least three post segments each comprise at least two opening-engaging structures, each opening-engaging structure corresponding to one of the rows of openings in the first and second post segments, respectively; and securing (i) the first of the at least three post segments to the base, (ii) the second of the at least three post segments to the first post segment by engaging the opening-engaging structures of the second post segment with a pair of corresponding openings in the first post segment, (iii) the third of the at least three post segments to the second post segment by engaging the opening-engaging structures of the third post segment with a pair of corresponding openings in the second post segment, (iv) the backboard to the third post segment, and (v) the rim to the backboard.

BRIEF DESCRIPTION OF THE DRAWINGS

Features of the present disclosure which are believed to be novel are set forth with particularity in the appended claims.

Embodiments of the disclosure are disclosed with reference to the accompanying drawings and are for illustrative purposes only. The disclosure is not limited in its application to the details of construction or the arrangement of the components illustrated in the drawings. The disclosure encompasses other embodiments and is capable of being practiced or carried out in other various ways. The drawings illustrate a best mode presently contemplated for carrying out the invention. Like reference numerals are used to indicate like components. In the drawings.

DETAILED DESCRIPTION

Figure 1A:
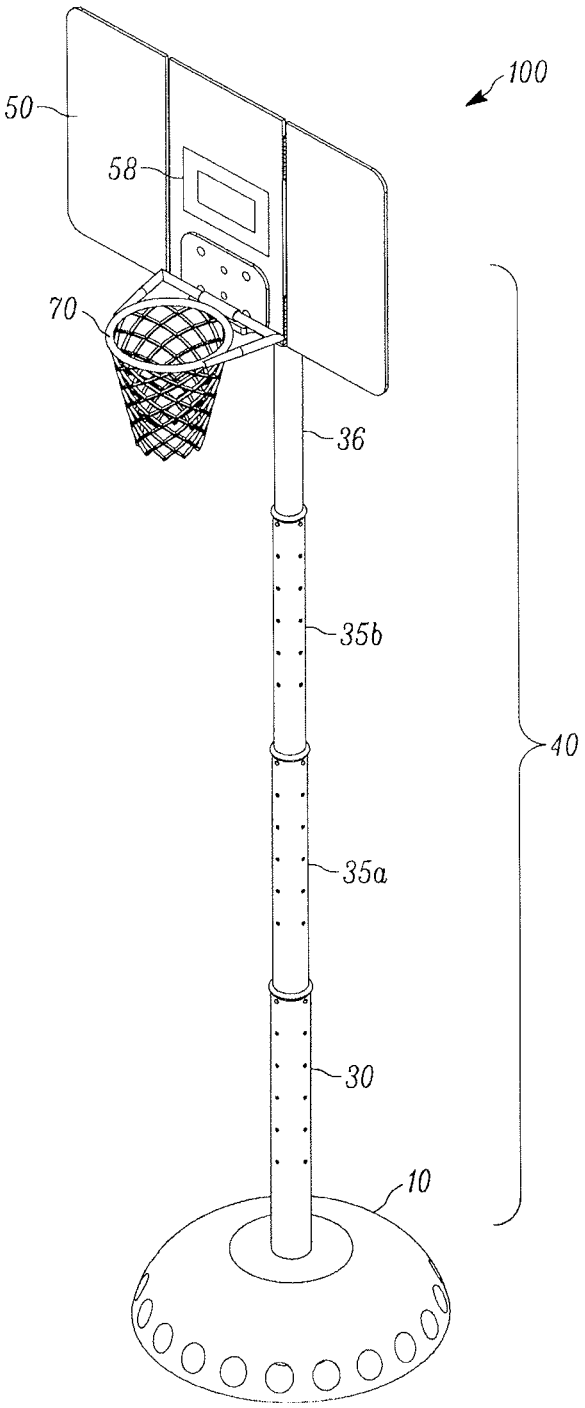
FIG. 1A is a perspective view of a portable basketball hoop in accordance with embodiments of the present disclosure.
Figure 1B:
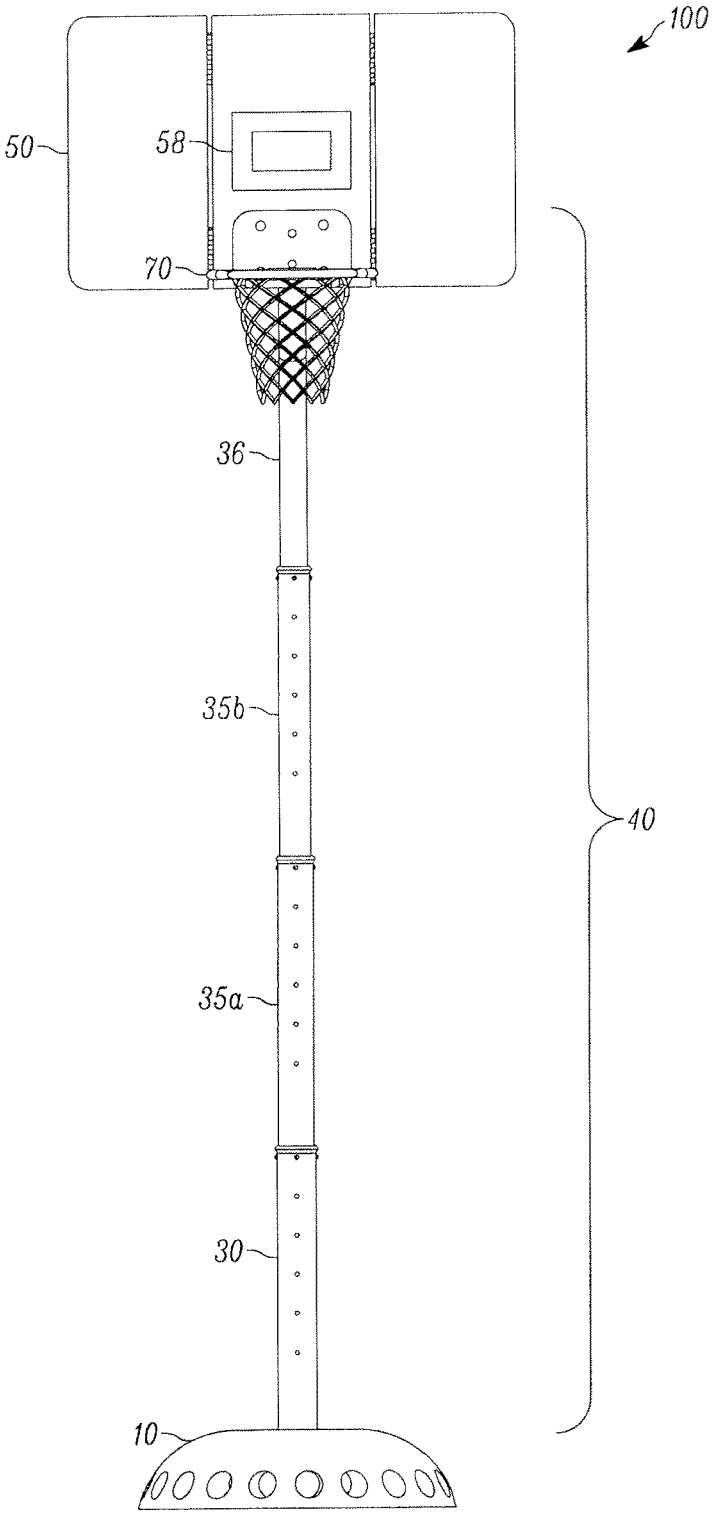
FIG. 1B is a front view of a portable basketball hoop in accordance with embodiments of the present disclosure.
Figure 1C:
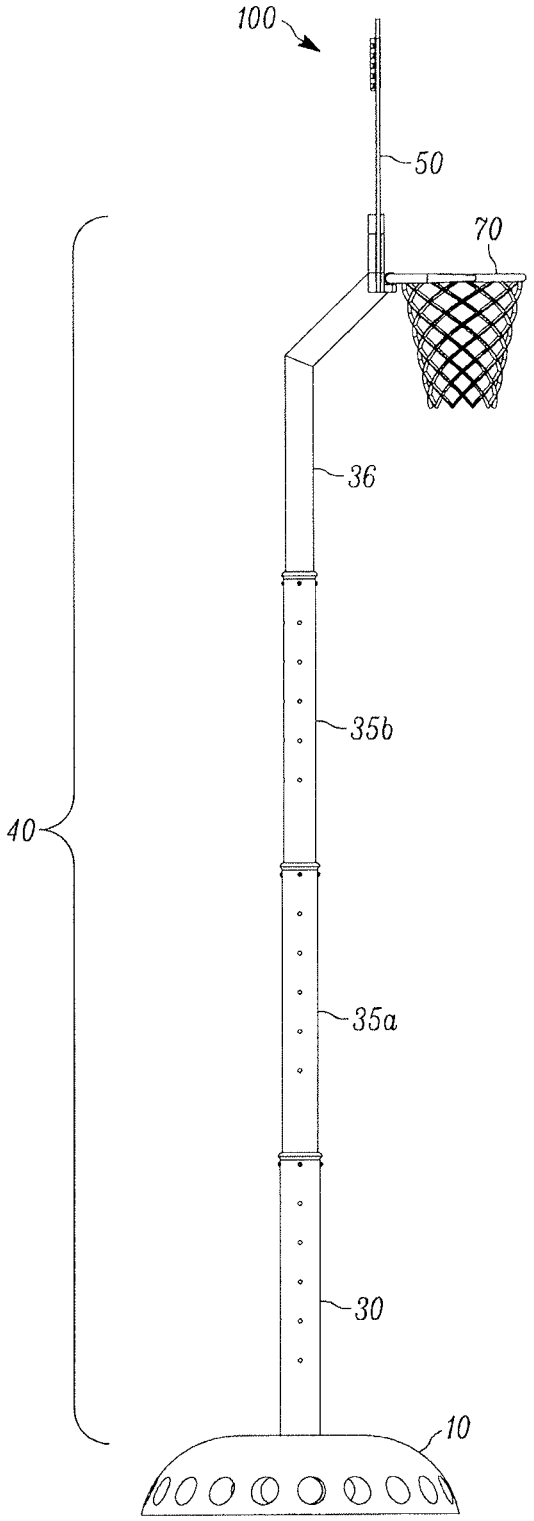
FIG. 1C is a side view of a portable basketball hoop in accordance with embodiments of the present disclosure.
Figure 1D:
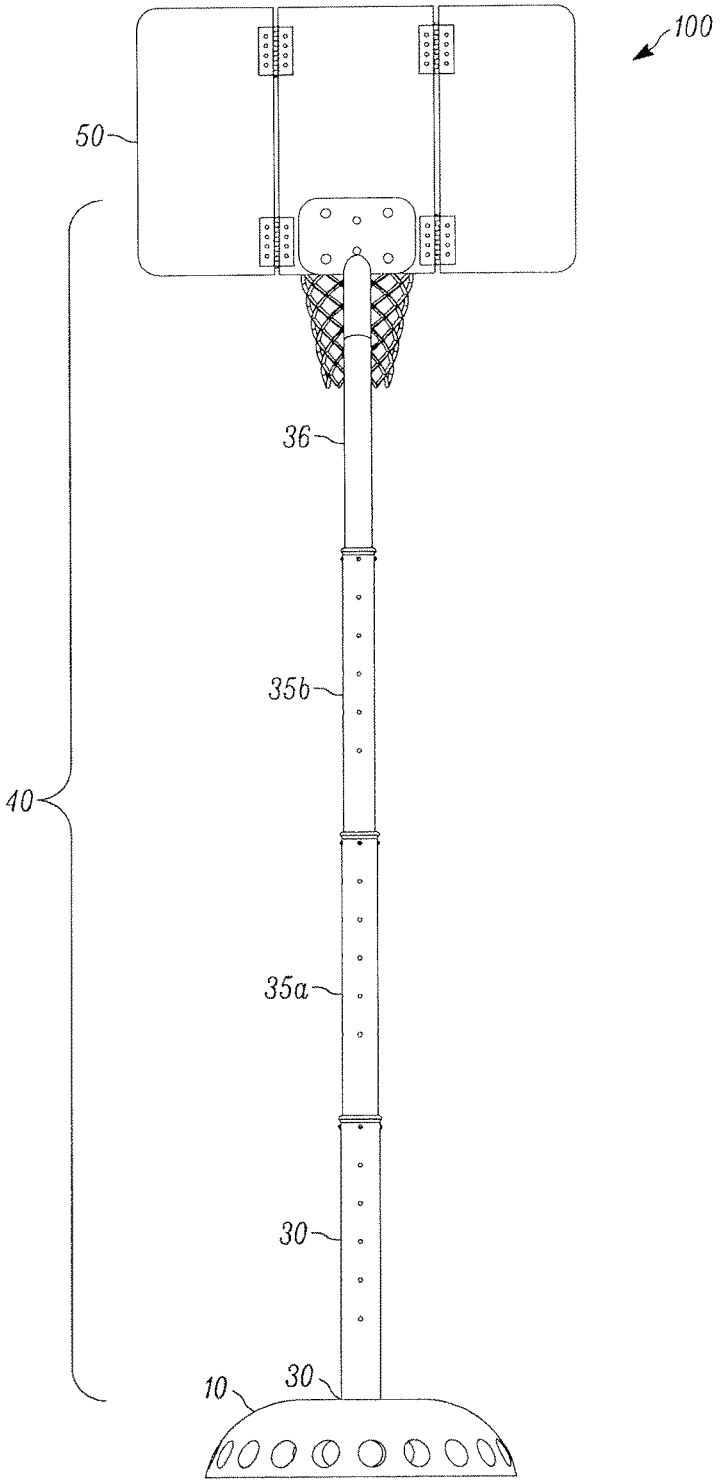
FIG. 1D is a back view of a portable basketball hoop in accordance with embodiments of the present disclosure.

In accordance with one embodiment, with reference to FIGS. 1A-1D, disclosed herein is a portable basketball hoop 100 including a base 10, pole or post 40, backboard 50, and rim 70. The base 10 secures a bottom segment 30 of the post 40, and the backboard 50 attaches to a top segment 36 of the post 40. The rim 70 attaches to the backboard 50.

Figure 3A:
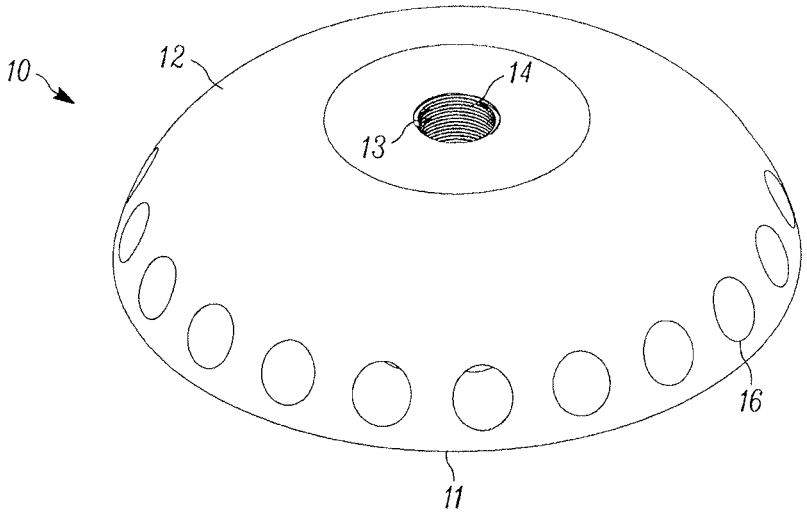
FIG. 3A is a perspective view of a base for a portable basketball hoop in accordance with embodiments of the present disclosure.
Figure 3B:
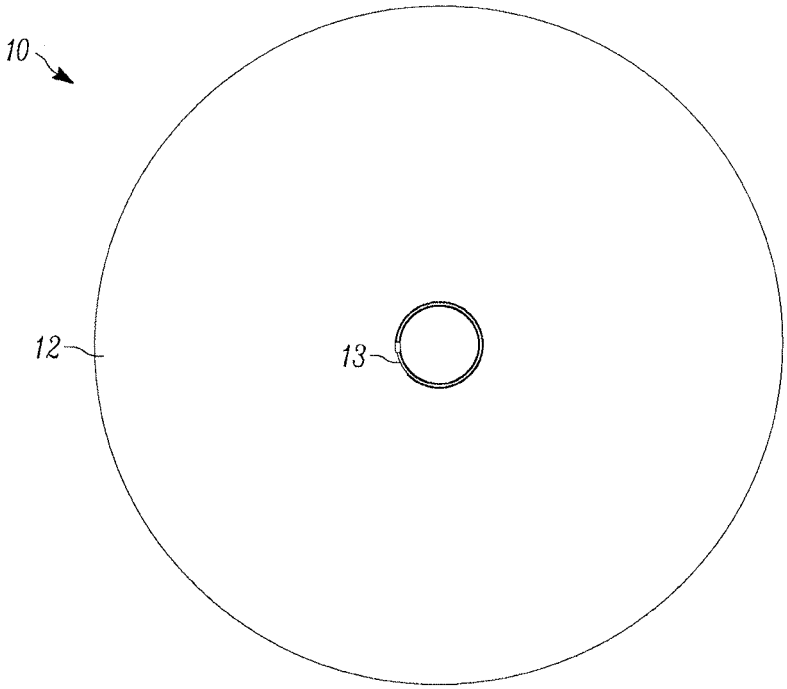
FIG. 3B is a top view of a base for a portable basketball hoop in accordance with embodiments of the present disclosure.
Figure 3C:
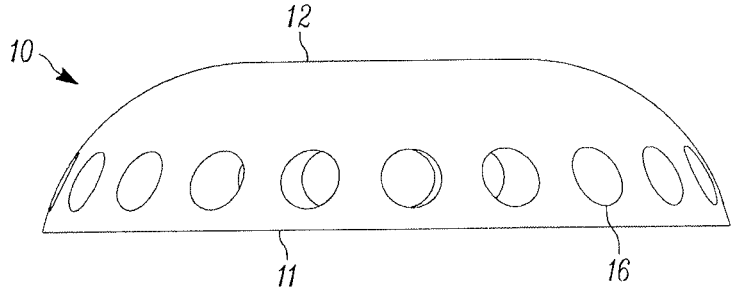
FIG. 3C is a side view of a base for a portable basketball hoop in accordance with embodiments of the present disclosure.

With reference to FIGS. 3A-3C, the base 10 has a flat bottom surface 11 and an upper surface 12 with an opening 13 configured to engage the bottom segment 30 of the post 40. In the embodiment shown, the base 10 is approximately hemispherical, or hemispherical. In still further embodiments, the base 10 may have an approximately hemispherical shape with a flattened upper surface 12, particularly in the area with the opening 13.

Figure 2A:
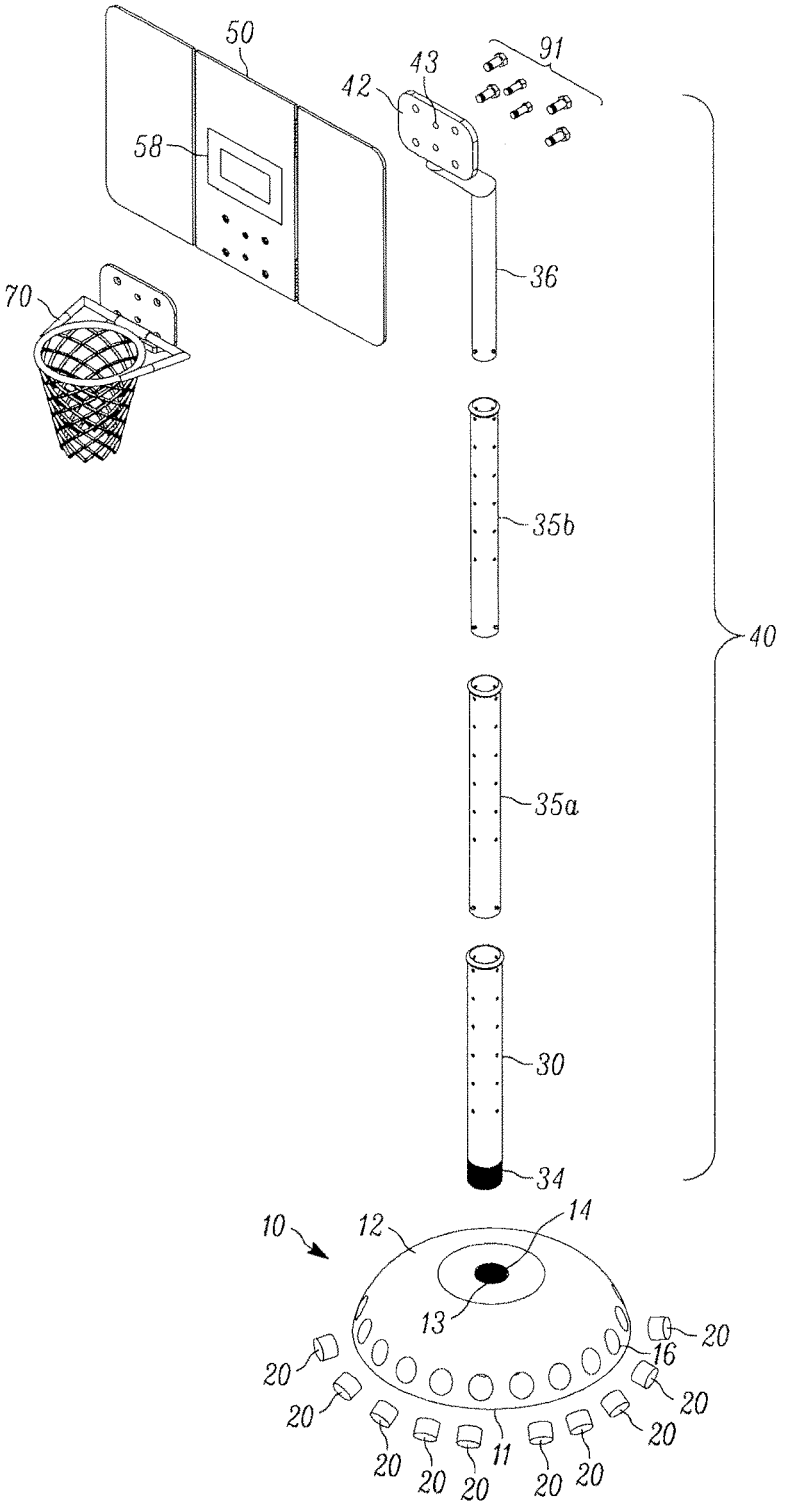
FIG. 2A is an exploded view of a portable basketball hoop in accordance with embodiments of the present disclosure.
Figure 2B:
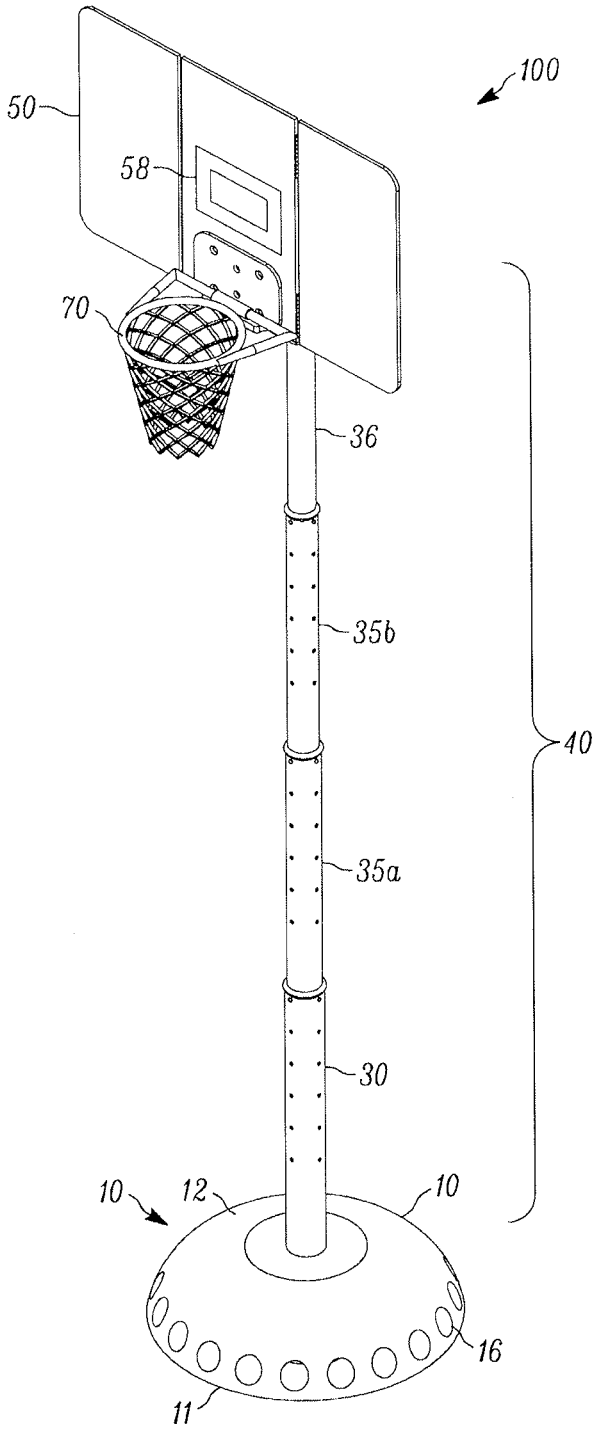
FIG. 2B is an assembled view of a portable basketball hoop in accordance with embodiments of the present disclosure.

In the exemplary embodiment shown, the opening 13 includes an internal structure 14, which in the exemplary embodiment shown is internal threads, which match the corresponding external structure 34 of the bottom segment 30 so that the post 40 may be secured in the base 10 by the interlocking threads 14, 34 (see FIGS. 2A-2B).

Figure 5A:
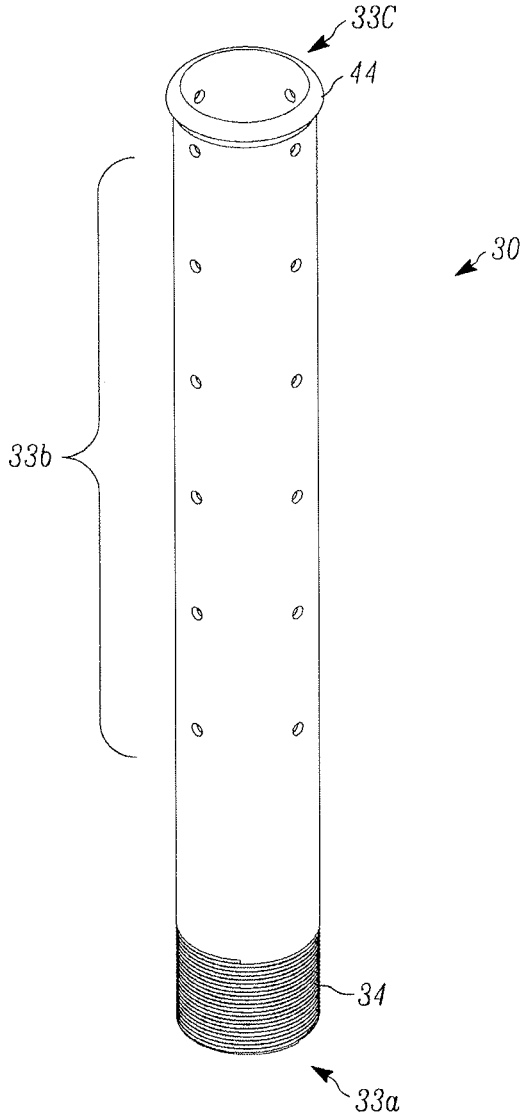
FIG. 5A illustrates an exemplary first post section of a portable basketball hoop in accordance with embodiments of the present disclosure.

While in the embodiments shown, the internal and external structures 14, 34) are threads, as shown clearly in FIGS. 3A and 5A, the internal and external structures 14, 34 may be other structures which secure the bottom segment 30 of the post 40 to the base 10, such as, for example, other interlocking structures.

The base 10 also includes a plurality of openings 16 around the perimeter near the bottom surface 11. These openings 16 may contain weights 20 (see FIGS. 2A-2B) to stabilize the base 10 and, ultimately, portable basketball hoop 100. In the embodiment shown, the base 10 includes approximately 20 openings 16, although any number of openings 16 may be provided to receive weights.

In the embodiment shown, the openings 16 occur circumferentially around the perimeter of the entire base 10 and are equally spaced around the perimeter of the base 10. The individual openings 16 are arranged such that they project radially from the center of the base 10. With this arrangement, a given amount of weight determined to be necessary to stabilize the portable basketball hoop 100 may be equally positioned around the base 10. In alternative embodiment, the base 10 may have openings 16 along only a portion of its perimeter. For example, by providing openings 16 around only a rear two-thirds or three-quarters of the base 10, it may be possible to provide a base 10 having a truncated front side such that the base 10 does not project as far under the net 70 to reduce obstacles which may hinder game play.

In the embodiments shown, such as, for example, in FIGS. 1A-2B, openings 16 are approximately tubular hollow recess in the base 10. In other words, the interior sides of the openings 16 are arcuate such that a cross-section of the openings 16 is approximately circular, or circular, as shown in FIG. 1A. In further embodiments, such as, for example, shown in FIGS. 4A and 4B, the openings 16 may have different geometries in order to accommodate different weight systems and/or base 10 designs.

In the embodiment shown in FIGS. 2A-2B, the weights 20 are each approximately 5-20 pounds. The total amount of weight used to stabilize the base 10 depends at least in part on the age and/or size and/or weight of the players and the playing style of those players. For example, when children are playing and not likely to exert significant force on the basketball hoop 100, less weight needs to be used than when, for example, young adults are playing a competitive game of basketball. The total amount of weight used will therefore, at least in part, determine the specific weight of each individual weight 20 and the number of weights 20 to be used. When possible, it is preferred to distribute the total weight as evenly as possible around the base 10.

While the weights 20 shown are approximately 5-35 pounds, it is understood that different weights may be used, including for example weights of less than 5 pounds and weights over 35 pounds. It was found, however, that weights under 5 pounds provided little benefit and weights over 35 pounds were cumbersome to transport and difficult to place in the base 10. In an embodiment, weights 20 of approximately 10-20 pounds are preferred.

In the embodiments shown, particularly with respect to FIG. 2A, the weights 20 are shown as approximately cylindrical and having a geometry corresponding to that of the openings 16. However, in further embodiments, the weights 20 may have any shape or geometry which is capable of being inserted completely into the openings 16. In still further embodiments, the weights 20 may be conformable to different geometries, such as, for example, in the case of "beanbags" or other similar configurations including a weight-filled flexible pouch.

Figure 4A:
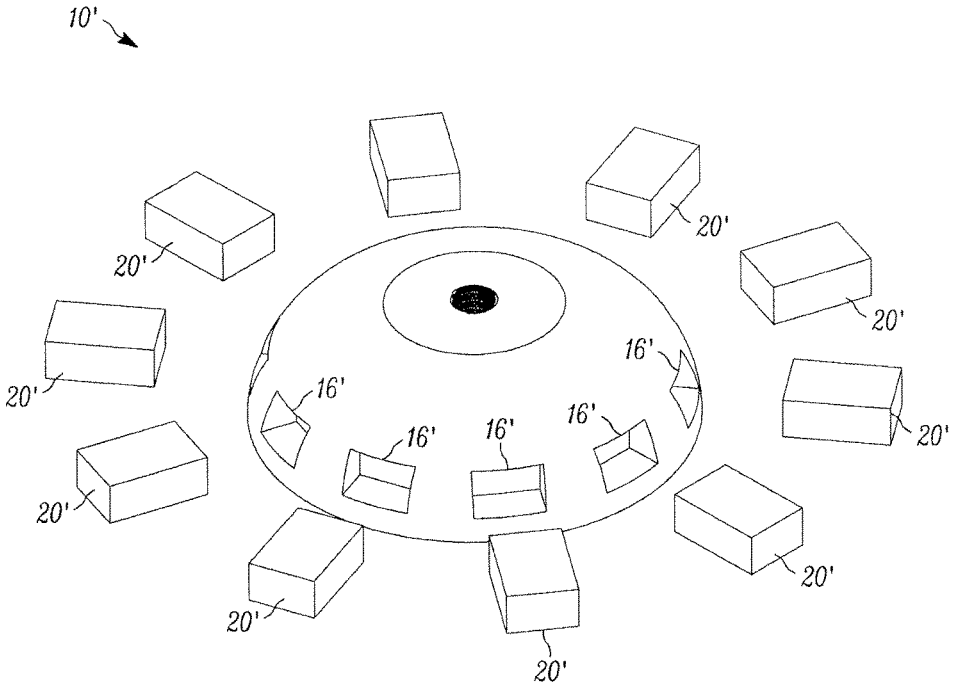
FIGS. 4A and 4B illustrate an alternative embodiment of a base for a portable basketball hoop in accordance with embodiments of the present disclosure.
Figure 4B:
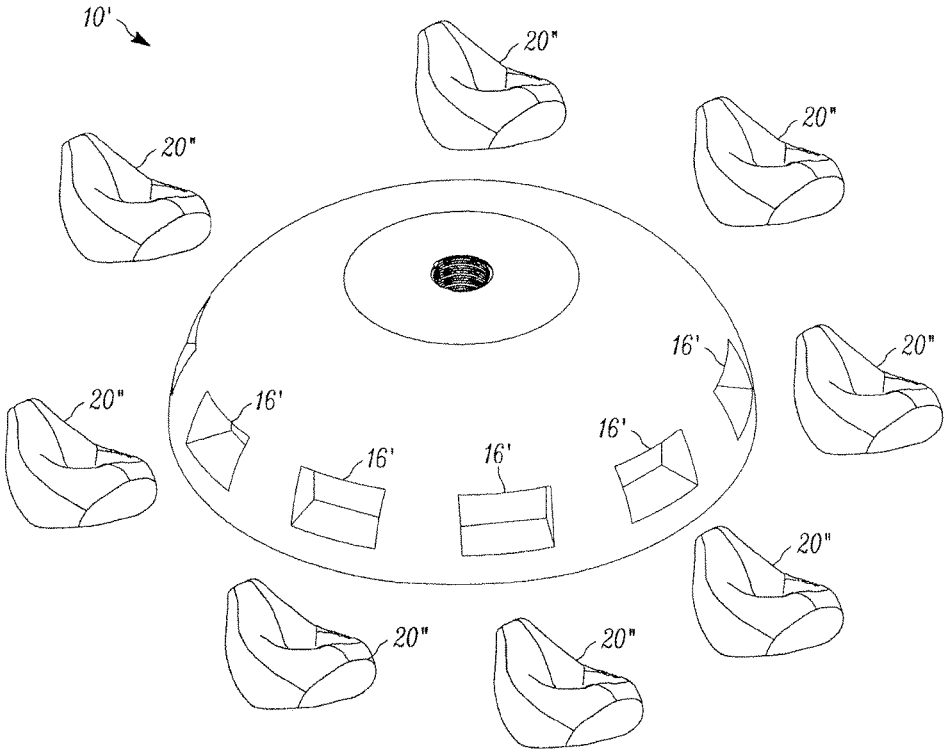

FIGS. 4A and 4B illustrate an alternative embodiment of a base 10' for a portable basketball hoop. In the exemplary embodiment shown in FIGS. 4A and 4B, the base 10' is approximately hemispherical, or hemispherical, and includes a plurality of openings 16' around the bottom perimeter of the base 10'. However, in the embodiment shown, the openings 16' are squared/rectangular instead of cylindrical/rounded. FIGS. 4A and 4B show further embodiments of the weights 20'/20". In the embodiment shown in FIG. 4A, weights 20' are shown as rectangular brick-like structures. These weights 20', like weights 20, are approximately 5-35 pounds. By using a squared/rectangular shape for the weights 20', the weights 20' have a slightly greater weight than cylindrical/rounded weights 20 of equivalent size because the corners of weights 20' are not rounded off.

FIG. 4B also shows weights 20" are soft-sided pouches which are fillable with any material having a desired weight. For example, in some embodiments, the soft-sided pouches of weights 20" are transported unfilled and later filled by material/items found at the location at which the basketball hoop 100 is being assembled (e.g., sand, water, rocks, etc.). In other words, the weights 20" are similar to "bean-bags". The weights 20" may be conformable to accommodate different sizes/shapes of openings. Using weights 20" also allows a user to choose how much weight is in a weight pouch to better distribute weight around the base 10".

In the embodiment shown in FIGS. 3A-3C, the bottom surface 11 of the base 10 is approximately circular and the base 10 has an overall approximately domed shaped. In other embodiments, the bottom surface 11 of the base 10 may have different shapes and/or geometries (e.g., square, oval, rectangular, polygon) and the base 10 may have a corresponding overall three-dimensional shape (e.g., pyramidal, cylindrical, etc.). The overall shape and geometry of the base 10 may, in some embodiments, be determined by the dimensions of any travel bag 80 (such as, for example, shown in FIGS. 13A-14) which may be used to store and transport the basketball hoop 100.

Figure 6:
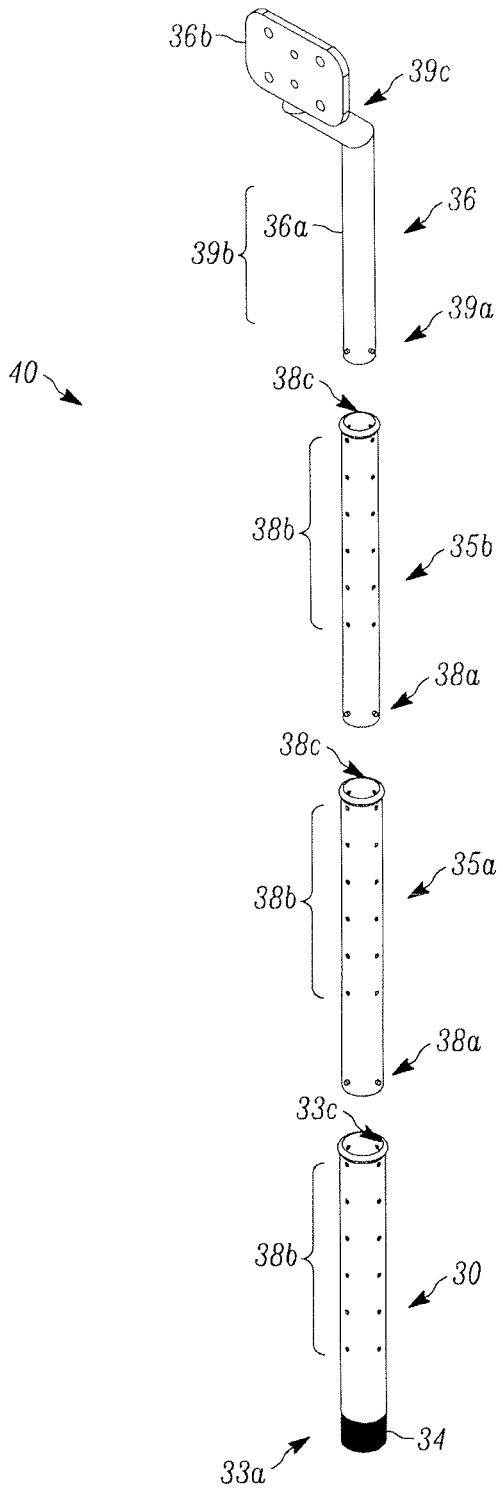
FIG. 6 illustrates four post sections which form a post of a portable basketball hoop in accordance with embodiments of the present disclosure.

As shown perhaps most clearly in FIGS. 2A-2B, the post 40 is composed of a number of post sections or segments, including a bottom (first) post section 30, at least one middle post section 35 and a top (final) post section 36. In the embodiment shown, the post 40 includes two middle post sections 35*a*, 35*b* for a total of four post sections which for the post 40, as shown in FIG. 6. However, in further exemplary embodiments, the number of middle post sections 35 may vary to convenience.

In the exemplary embodiment shown in FIG. 6, each of the post sections 30, 35*a*, 35*b* and 36 includes a bottom portion 33*a*, 38*a*, 38*a*, 39*a*, respectively, a body portion 33*b*, 38*b*, 38*b*, 39*b*, respectively, and a top portion 33*c*, 38*c*, 38*c*, 39*c*, respectively. The bottom portions 33*a*, 38*a*, 38*a*, 39*a* each include a structure used to secure the respective portion to the one directly below. For example, as shown in FIG. 5A, the bottom portion 33*a* of the first section 30 contains external structures 34 which in the embodiment shown are threads which correspond to, so as to threadingly engage, the internal threads 14 of the opening 13 of the base 10. Similarly, as shown in FIGS. 5B, 5E, 5F and 5G, the bottom portions 38*a*, 38*a*, 39*a* of the middle and top sections 35*a*, 35*b*, 36 each include a plurality of structures 49 (e.g., locking structures) which engage locking structure-engaging areas 48 in the post section immediately below the respective post sections (see FIG. 5B).

As described with further detail below, in the exemplary embodiment shown, the locking structures 49 are pins which are secured directly to the respective post segments and configured to engage the locking structure-engaging areas of a post section immediately below the respective post section. However, the locking structures 49 can take the form of a variety of opening-engaging structures, including, for example, a further opening in combination with a physically separate locking hardware structure, such as a lock pin. In still further embodiments, the opening-engaging structures 49 may include spring-activated pins, other friction-connect structures, and combinations of these structures. However, for clarity, in the embodiments described below, reference will be made to locking structures 49 which are pins and locking structure-engaging areas 48 which are openings.

Further, and with reference to FIGS. 5A-5E, the body portions 33*b*, 38*b*, 38*b*, 39*b* of the sections 30, 35*a*, 35*b*, 36 are substantially tubular with a length of approximately from 22 inches, or from 23 inches, or from 24 inches, or from 25 inches, or from 26 inches, or from 27 inches, or from 28 inches to 36 inches, or to 35 inches, or to 34 inches, or to 33 inches, or to 32 inches, or to 31 inches, or to 30 inches. In a preferred embodiment, the body portions 33*b*, 38*b*, 38*b*, 39*b* of the sections 30, 35*a*, 35*b*, 36 have a length of approximately from 24 inches, or from 25 inches, or from 26 inches, or from 27 inches, or from 28 inches to 30 inches, or to 31 inches, or to 32 inches, or to 33 inches, or to 34 inches. In a more preferred embodiment, the body portions 33*b*, 38*b*, 38*b*, 39*b* of the sections 30, 35*a*, 35*b*, 36 have a length of approximately from 28 inches to 30 inches. In still a further preferred embodiment, the body portions 33*b*, 38*b*, 38*b*, 39*b* of the sections 30, 35*a*, 35*b*, 36 have a length of approximately 29 inches or 32 inches. In still further embodiments, post sections 30, 35*a*, 35*b*, 36 may be provided with body portions 33*b*, 38*b*, 38*b*, 39*b* of varying lengths to permit the height of the basketball hoop 100 to be adjusted to a desired height (e.g., where the rim is 10 feet above the ground).

Figure 5B:
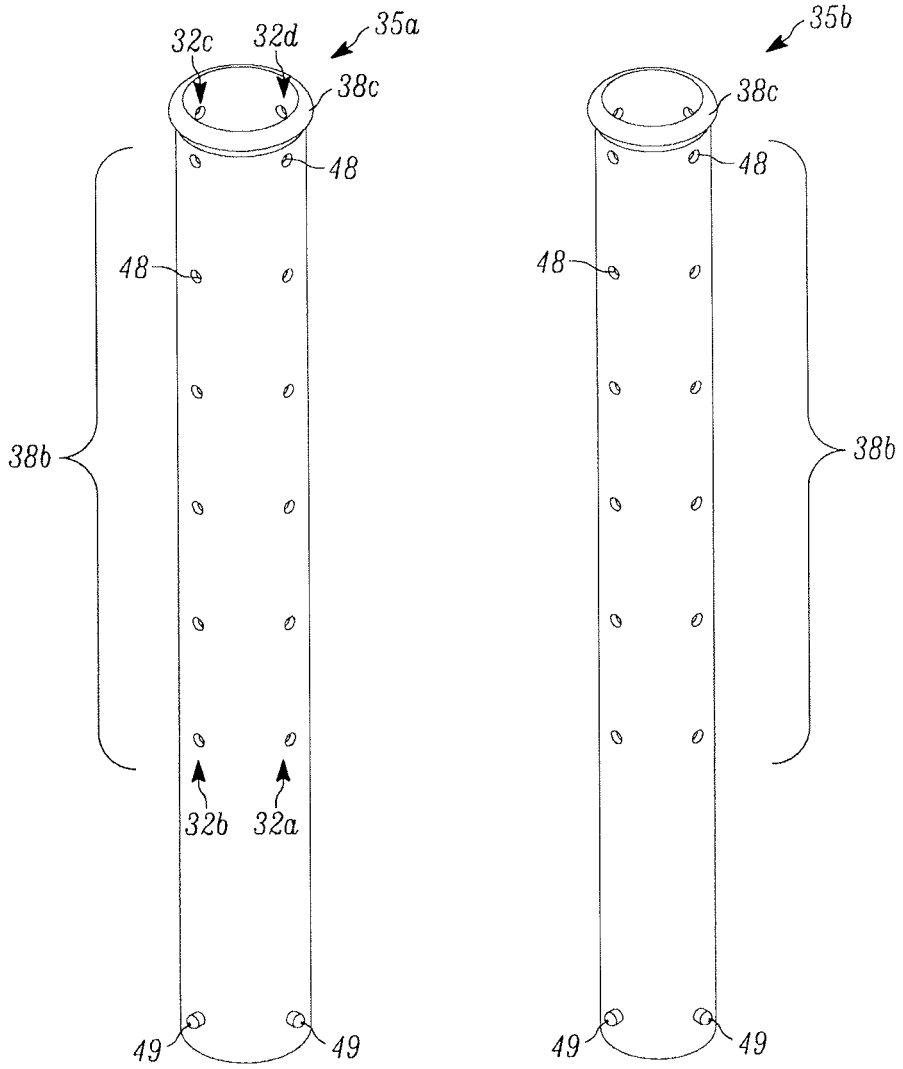
FIG. 5B illustrates an exemplary middle post section of a portable basketball hoop in accordance with embodiments of the present disclosure.

As shown in FIGS. 5A and 5B, the body portions 33*b*, 38*b*, 38*b* of the bottom and middle sections 30, 35*a*, 35*b* of the post 40 include a plurality of rows 32 of openings 48. As shown with reference to FIGS. 5F-5H, described in further detail below, the openings 48 are configured to engage a pin 49 on another post section. In the embodiment shown, the body portions 33*b*, 38*b*, 38*b* include four rows 32*a*, 32*b*, 32*c*, 32*d* of openings 48, meaning the next post section includes four pins 49*a*, 49*b*, 49*c*, 49*d* (see FIGS. 5F-5H).

Figure 5C:
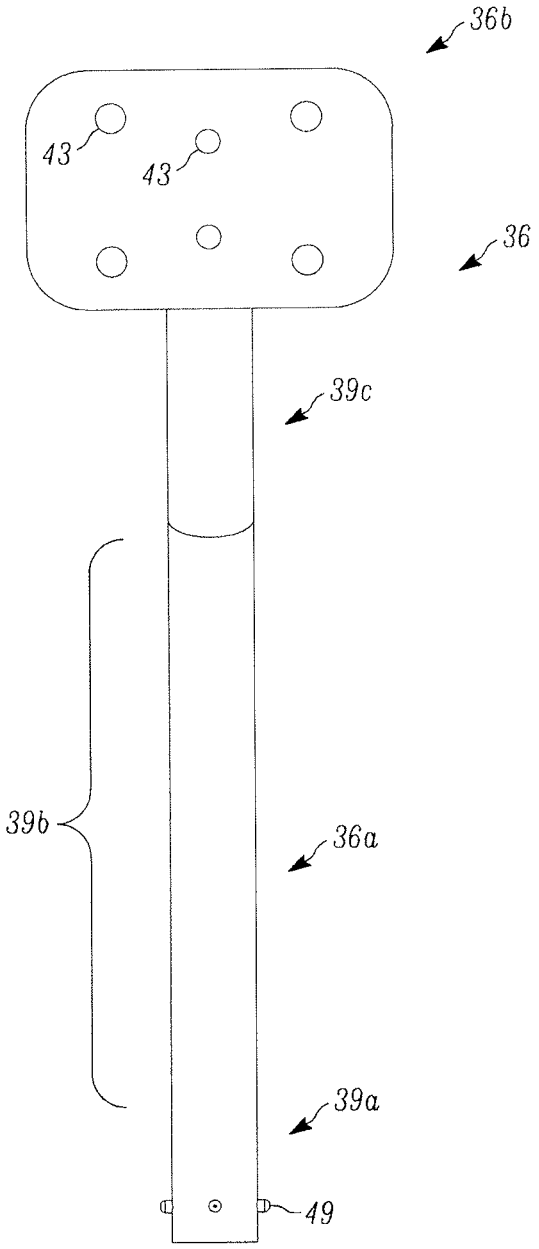
FIG. 5C is a front view an exemplary top post section of a portable basketball hoop in accordance with embodiments of the present disclosure.
Figure 5D:
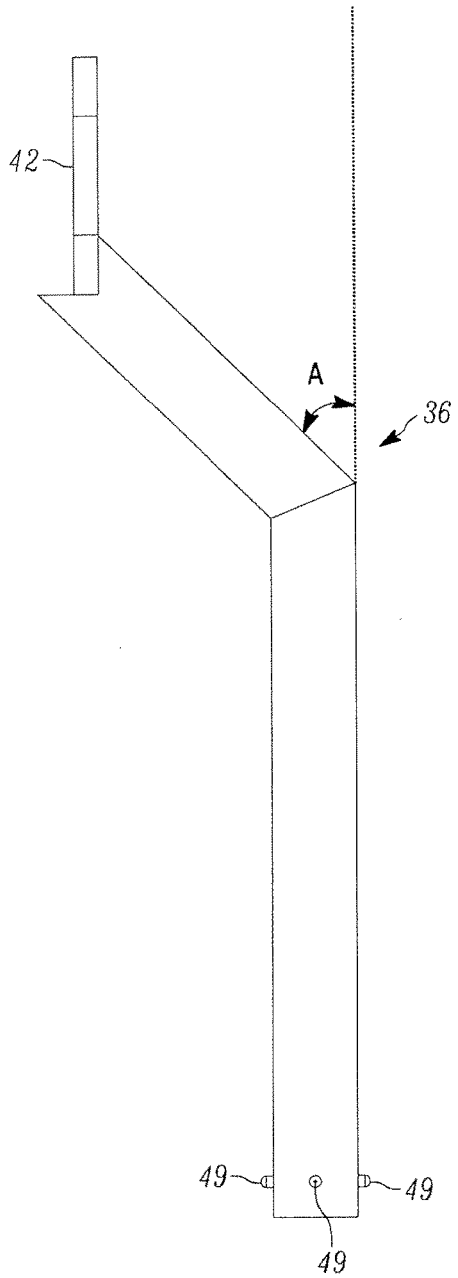
FIG. 5D is a side view of an exemplary top post section of a portable basketball hoop in accordance with embodiments of the present disclosure.
Figure 5E:
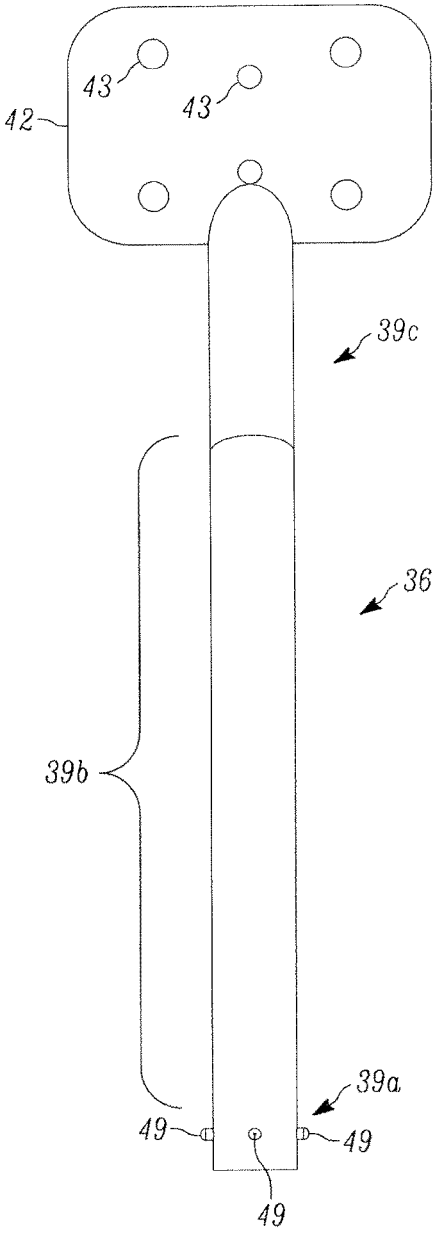
FIG. 5E is a back view of an exemplary top post section of a portable basketball hoop in accordance with embodiments of the present disclosure.
Figure 5F:
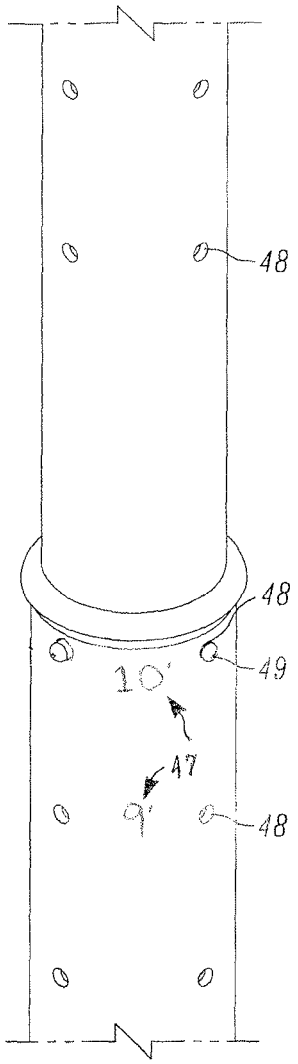
FIG. 5F illustrates the connection between two post sections of a portable basketball hoop in accordance with embodiments of the present disclosure.
Figure 5G:
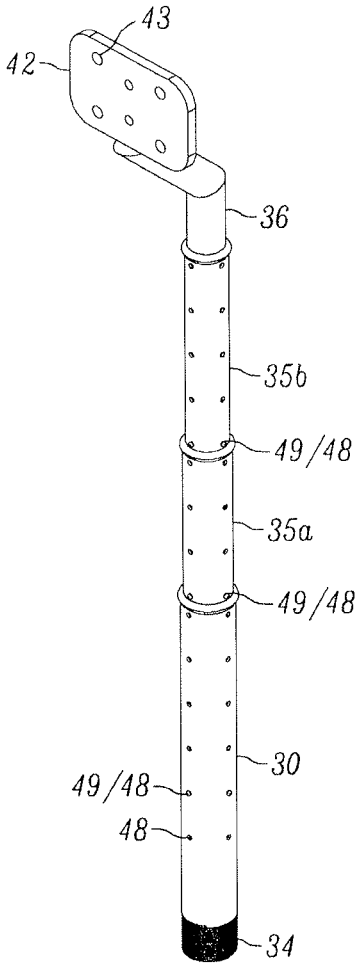
FIGS. 5G and 5H illustrate the height-adjustability of an exemplary post of a portable basketball hoop in accordance with embodiments of the present disclosure.
Figure 5H:
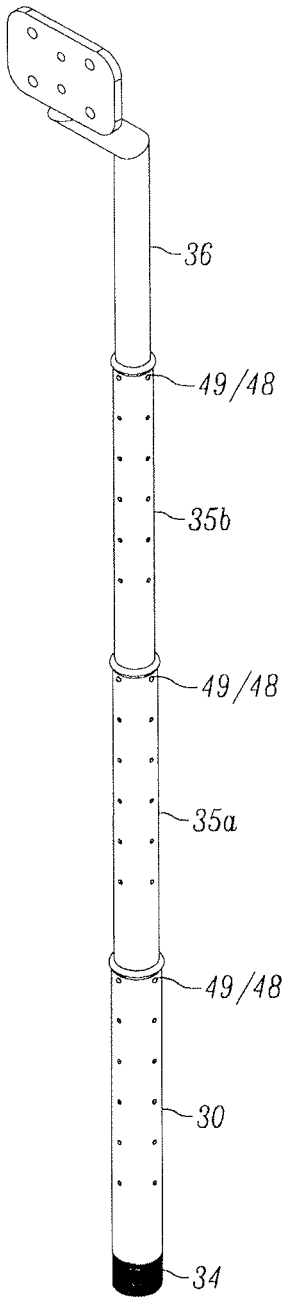

With reference to FIGS. 5F-5H, it should be understood that the respective openings 48 in each of the rows 32*a*, 32*b*, 32*c*, 32*d* are in the same plane to form sets of openings. In the exemplary embodiment shown, each row 32*a*, 32*b*, 32*c*, 32*d* includes 6 openings, thereby forming six "sets" of openings. Furthermore, the first opening in each of the rows is at the same height so as to be in the same plane, the second opening in each of the rows is at the same height, and so on. In other words, each of the openings of a set of openings is at the same height.

In some embodiments, particularly as shown in FIGS. 5F-5H in which the body portions 33*b*, 38*b*, 38*b* each include four rows of openings as described above so as to be arranged in sets of openings, each set including four openings at the same height, a first of the openings in each set of four openings has a corresponding second opening which is coaxial with the first opening. Similarly, the third opening in the sets of four openings has a corresponding fourth opening which is coaxial with the third opening. Thus, sets of four openings having pairs of coaxial openings are formed.

In embodiments in which the body portions 33*b*, 38*b*, 38*b* each include two rows of openings, the corresponding openings are coaxial with one another.

Each "set" of openings corresponds to a desired height placement level for a subsequent post section. For example, when post section 35*a* is connected with section 35*b*, as shown in FIG. 5F, the pins 49 on section 35*b* each engage an opening 48 at the same height in each of the rows row 32*a*, 32*b*, 32*c*, 32*d*, or a given "set" of openings 48. In other words, each "set" of openings 48 corresponds to a given height at which a post section is secured.

For example, as shown in FIG. 5G, a shorter post 40 may be provided by engaging lower openings 48 in the rows of openings. In the embodiment, shown in FIG. 5G, the top post section 36 is engaging the $5^{th}$ set of openings of the middle section 35*b* as counted from the top portion 38*c* of the middle section 35*b*. The middle section 35*b* is engaging the $4^{th}$ set of openings of the middle section 35*a* as counted from the top portion 38*c* of the middle section 35*a*. The middle section 35*a* is engaging the $5^{th}$ set of openings of the bottom section 30 as counted from the top portion 33*c* of the bottom section 30. The height of the post 40 may be further decrease by engaging subsequent sets of openings with each post section. The height of the post 40 may also be increased, as shown in FIG. 5H, by engaging higher sets of openings. For example, in FIG. 5H, the post segments 36, 35*b*, 35*a* each engage the first set of openings of post segments 35*b*, 35*a*, and 30, respectfully, to achieve a post 40 which is as fully extended (e.g., high) as permitted by that embodiment. In view of the above, and with reference to FIGS. 5G and 5H, it is understood that the post 40 has an amount of height adjustability.

It is further understood that more or fewer openings 48 may be provided in the rows 32*a*, 32*b*, 32*c*, 32*d* to permit more or less adjustability. Similarly, more or fewer rows of openings may be provided. In an exemplary embodiment, for example, a larger diameter post 40 may benefit from additional rows of openings and corresponding pins to provide additional stabilization. Likewise, fewer rows of openings and corresponding pins may be used when the structure and configuration of the post 40 is such that fewer securing structures may be used.

In the exemplary embodiment shown, the openings 48 are positioned on the post segments 30, 35*a*, 35*b* such that the highest openings 48 occur at the top of the body portions 33*b*, 38*b*, 38*b*. In an embodiment, each lower opening 48 is separated from the one above by a distance of up to approximately 4 inches, or 3 inches, or 2 inches, or 1 inch. In a further embodiment, the openings 48 may be equally spaced along the height of the body portions 33*b*, 38*b*, 38*b*.

In an embodiment, the total height of the post 40 is adjustable such that the distance from the bottom surface of the base 10 to the top edge of the rim 70 is from approximately 5 feet, or 5.5 feet, or 6 feet, or 6.5 feet, or 7 feet to 10 feet, or 10.5 feet, or 11 feet, or 11.5 feet, or 12 feet. In an embodiment, the maximum height of the basketball hoop 100 as measured from the bottom surface 11 of the base 10 to the top edge of the rim 70 is 10 feet. In an embodiment, the minimum height of the basketball hoop 100 as measured from the bottom surface 11 of the base 10 to the top edge of the rim 70 is 5 feet.

In one exemplary embodiment, the base 10 has a total height (e.g., from the bottom surface to the top of the upper surface) of approximately 12 inches (1 foot), the top edge of the rim 70 is approximately 3 inches upward from the lower edge 51 of the backboard 50, and the upper post segment 36 raises the bottom edge 51 of the backboard 50 9 inches from the opening-engaging structures 49 of the upper post segment 36. In such embodiments, in order to reach a regulation height of 10 feet, in embodiments in which four total post segments are used, the remaining three post segments 30, 35*a*, 35*b* may each have body portions 33*b*, 38*b*, 38*b* which, when the first opening 48 in each post segment, are 32 inches long.

While 10 feet, as measured from the ground (bottom surface of the base 10) to the top edge of the rim 70, is the standard regulation height for basketball hoops, it may in some instances be desirable to have a basketball hoop 100 having a different height. For example, a shorter height may be desired when children are playing. In other embodiments, a taller height may be desired when players are looking for a challenge or attempting trick shots.

In still a further embodiment, the openings 48 may be specifically arranged such that connecting the post sections 30, 35*a*, 35*b* and 36 is a predetermined and identified selection of openings 48 results in a specific overall post height. For example, such as with respect to FIG. 4F, markings 47 next to specific openings 48 may indicate a resulting post or rim height. In some embodiments, the openings 48 may be configured such that assembling the basketball hoop 100 using every provided post segment portion, and securing each post segment portion in a respective "tallest" opening 48, results in a basketball hoop 100 having a total height, as measured from the bottom surface of the base 10 to the top edge of the rim 70, is 10 feet, as indicated by a 10' marking at the respective opening 48 on each segment. Similarly, using each post segment and the next opening 48 down may result in a total basketball hoop 100 height of 9 feet. In further embodiments, the openings 48 may each have a color around the opening 48 and/or inside the opening 48 and an assembly book, instruction book or other material provided with the basketball hoop 100 may provide as a quick reference to achieve a desired height by referencing a sequence of openings 48 by color.

By using pin/opening securing structures, the post 40 may be quickly and easily assembled/disassembled by depressing the pins 49 and sliding the post segment. For example, to assemble two sections, as shown, for example, in FIG. 5F, the pins 49 of the upper segment (segment 35*b* in FIG. 5F) and depressed and post section 35*b* is slid into post section 35*a* until the pins 49 engage the desired set of openings 48.

In further embodiments, the bottom portions 38*a*, 38*a*, 39*a* may include openings in place of the pins 49 and the pins 49 may be provided as separate hardware components. In such embodiments, the openings on the bottom portions 38*a*, 38*a*, 39*a* are aligned with corresponding openings 48 on the body portions 33*b*, 38*b*, 38*b* and the pins 49 are slide through the coaxial openings to releasably secure the post segments 30, 35*a*, 35*b*, 36 together.

In view of the above, it is understood that each post section 30, 35*a*, 35*b*, 36 is a hollow structure having a consistent internal diameter along the length of the body portions 33*b*, 38*b*, 38*b*, 39*b*. Specifically, in a preferred embodiment as shown, the body portions 33*b*, 38*b*, 38*b*, 39*b* are hollow, cylindrical, tubular structures having a consistent internal and external diameter over the length of the body portions 33*b*, 38*b*, 38*b*, 39*b*. In further embodiments, the body portions 33*b*, 38*b*, 38*b*, 39*b* may have alternative geometries, provided the body portions 33*b*, 38*b*, 38*b*, 39*b* remain hollow and with consistent internal dimensions (e.g., hollow squared tube, etc.).

In view of the above, it will be further understood that the inner dimensions (e.g., diameter) of the body portion of a first post section is slightly greater than the external dimensions (e.g., diameter) of the body portion of the subsequent post section (e.g., the post section that is slid into the first post section). In the exemplary embodiment shown, therefore, the body portion 33*b* of the first post section 30 has the largest inner dimensions (e.g., diameter), while the body portion 39*b* of the second middle portion 35*b* has the smallest inner dimensions (e.g., diameter). Similarly, the body portion 38*b* of the first middle post section 35*a* will have the largest outer dimensions (e.g., diameter) while the body portion 39*b* of the final post section 36 will have the smallest outer dimensions (e.g., diameter).

The post sections 30, 35*a*, 35*b*, 36 each further include an upper end portion 33*c*, 38*c*, 38*c*, 39*c*. As shown in FIGS. 5A and 5B, the first and middle post sections 30, 35*a*, 35*b* each have upper end portions 33*c*, 38*c*, 38*c* which include a terminating flange 44.

Figure 8A:
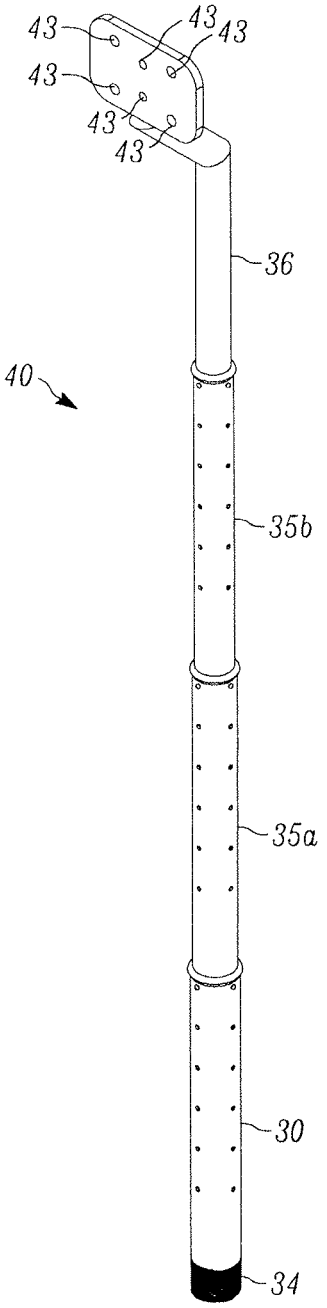
FIG. 8A is a perspective view of an assembled post for a portable basketball hoop in accordance with embodiments of the present disclosure.
Figure 8B:
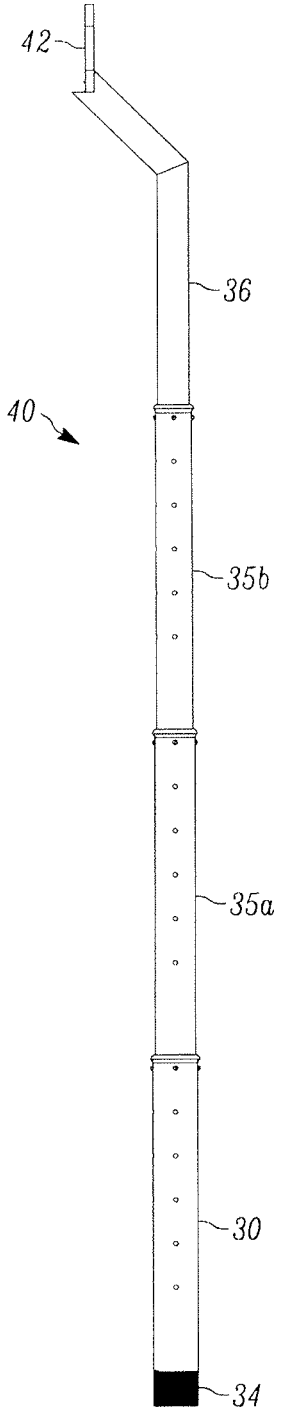
FIG. 8B is a side view of an assembled post for a portable basketball hoop in accordance with embodiments of the present disclosure.

As illustrated in FIGS. 5C-5E, the final (top) post section 36 has an upper end portion 39*c* which transitions from the post 40 to the backboard 50. Upper end portion 39*c* is angled away from the post 40 to extend the backboard 50 away from the post 40 as shown with reference to FIGS. 8A-8B. In the embodiment shown, the upper end portion 39*c* is at an angle A of approximately at least 20 degrees, or at least 25 degrees, or at least 30 degrees, or at least 35 degrees, or at least 40 degrees, or at least 45 degrees, or at least 50 degrees, or at least 55 degrees relative to the axis P of the post 40. In another embodiment, the upper end portion 39*c* is at an angle of approximately at most 90 degrees, or 85 degrees, or 80 degrees, or 75 degrees, or 70 degrees, or 65 degrees, or 60 degrees relative to the post 40.

In a further embodiment, the angle of the upper end portion 39*c* relative to the post 40 is approximately from 20 degrees, or 25 degrees, or 30 degrees, or 35 degrees, or 40 degrees to 80 degrees, or 75 degrees, or 70 degrees, or 65 degrees, or 60 degrees, or 55 degrees.

In an embodiment, the angle of the upper end portion 39*c* may be adjustable. For example, in an embodiment, the upper post section 36 may include a lever, rod, dial or pivot joint which permits a user to change the angle of the upper post section 36 relative to the post 40. In a further embodiment, the upper end portion 39*c* may be detachable from the upper post section 36 to form two separate upper post sections—a body section 36*a* and a back plate section 36*b*. In such an embodiment, the two upper post sections 36*a*, 36*b* may releasably secure to one another using pins and apertures such as described with reference to FIGS. 5F-5H, for example. In further embodiments, the two upper post sections 36*a*, 36*b* may releasably secure to one another using other means, including, but not limited, threaded connections, clips, locking components, bolts, and combinations of these and other structures.

Figure 8C:
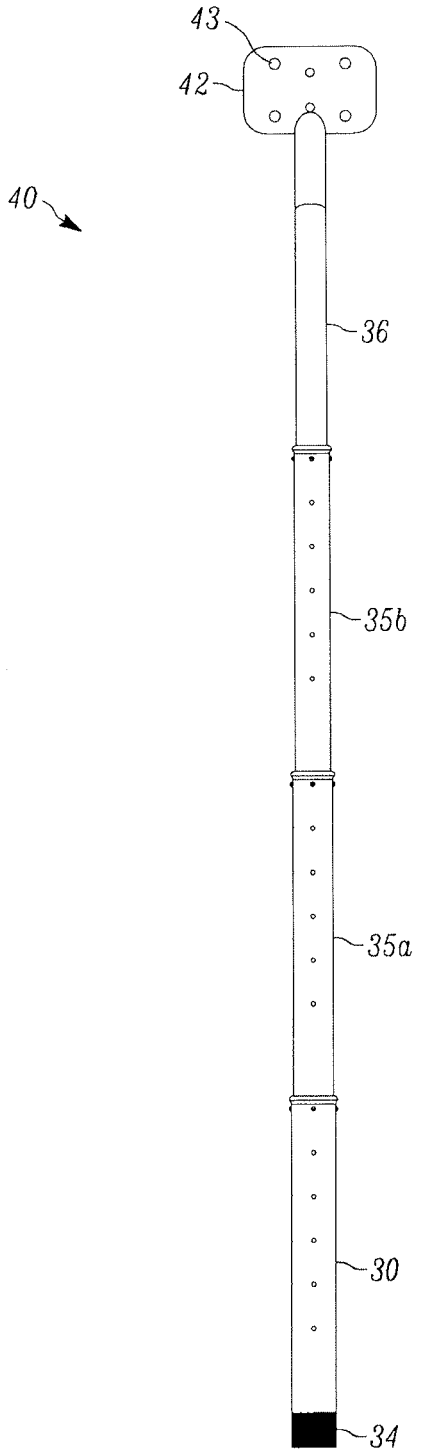
FIG. 8C is a back view of an assembled post for a portable basketball hoop in accordance with embodiments of the present disclosure.

With reference again to FIGS. 5C-5E, as well as FIG. 8C, the upper end portion 39*c* further includes a back plate 42. The back plate 42 includes at least one structure 43 used to secure the backboard 50 to the post 40 and, in some embodiments, the rim 70 to the backboard 50/post 40. In the exemplary embodiment shown, the securing structures 43 include a plurality of apertures configured to receive bolts which are secured in position using a washer and nut combination. In further embodiments, the securing structures 43 may be cage nuts contained in the back plate 42. Using cage nuts may in some embodiments reduce the hardware needed to assemble the basketball hoop 100 because the nuts are already provided and washers do not need to be used.

As shown with reference to FIGS. 2A and 2B, a plurality of bolts with nuts and washers 91 (collectively, hardware) is used to secure the backboard 50 and rim 70 to the back plate 42. In further embodiments, different hardware or securing structures may be used to releasably secure the backboard 50 and/or rim 70 to the back plate 42.

Figure 7A:
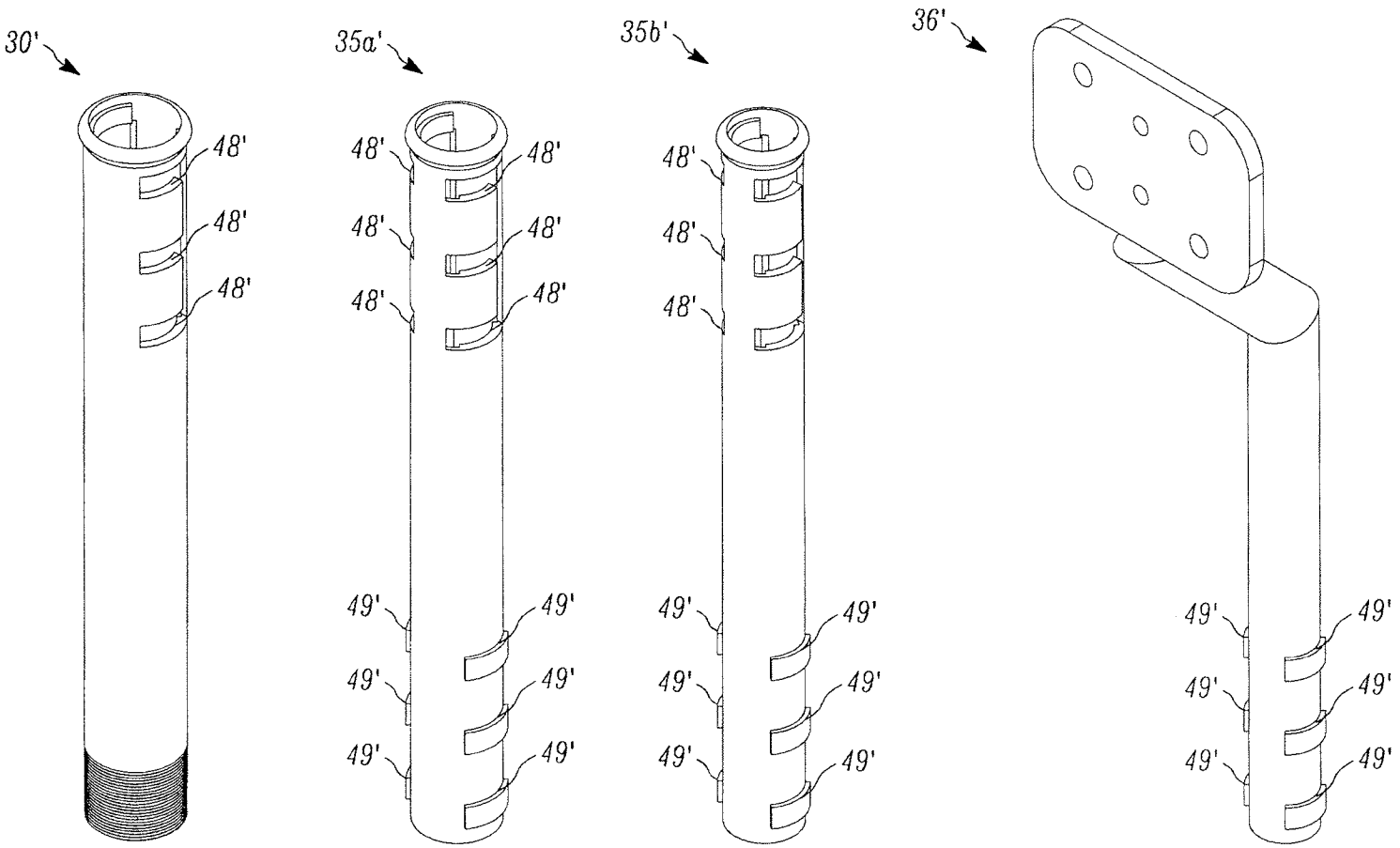
FIG. 7A illustrates an alternative embodiment of post sections of a portable basketball hoop which permit height adjustment in accordance with embodiments of the present disclosure.

Now with reference to FIG. 7A, an alternative embodiment of the post sections 30', 35*a*', 35*b*', 36' is shown. In the embodiment illustrated in FIG. 7A, each post sections 35*a*', 35*b*' and 36' include longitudinally spaced locking structures 49' which are male interrupted threads, which in the embodiment shown are illustrated as raised, partially cylindrical shaped portions. In some embodiments, however, the male interrupted threads may be squared. The male threads create an external diameter that fits within corresponding openings of the respective post sections 30', 35*a*' and 35*b*'. Furthermore, post sections 30', 35*a*', and 35*b*' include locking structure-engaging areas 48' which are internal female interrupted threads which engage the male interrupt threads to provide for height adjustment. In the embodiment shown, the female interrupted threads are illustrated as recessed partially cylindrical shaped portions/openings. However, as with the male interrupted threads, in further embodiments, the female interrupted threads may be squared.

Figure 7B:
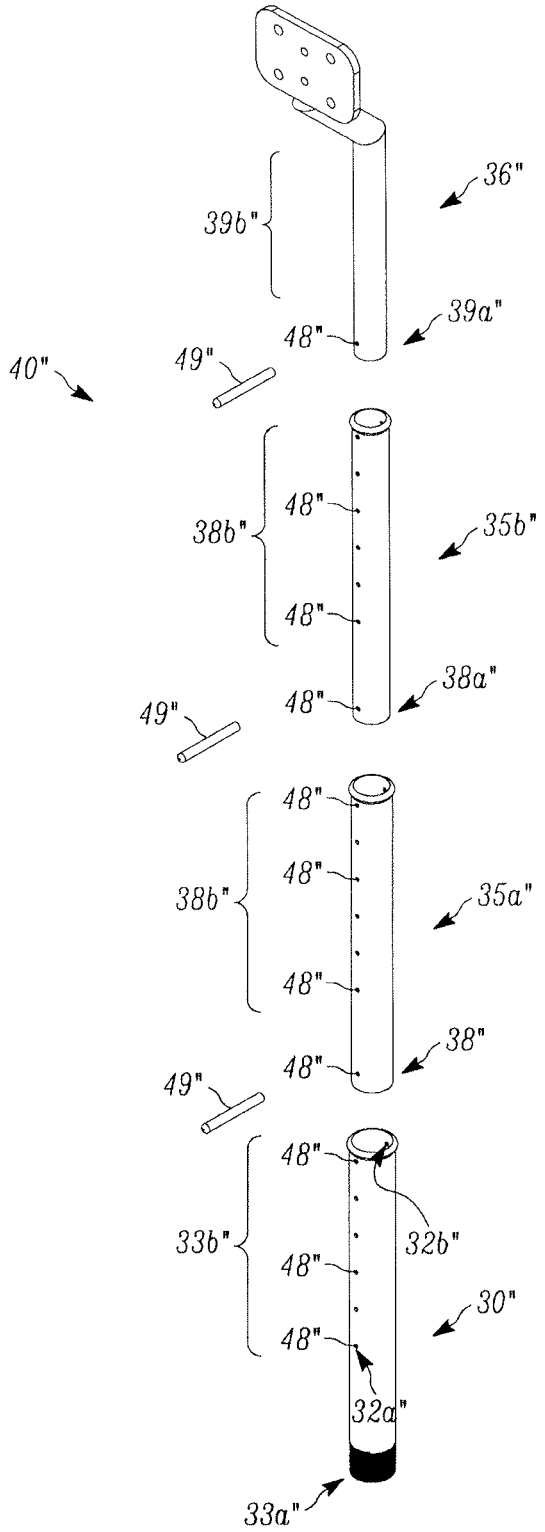
FIG. 7B illustrates a further alternative embodiment of post sections of a portable basketball hoop which permit height adjustment in accordance with embodiments of the present disclosure.

FIG. 7B shows a further alternative embodiment of the post sections 30", 35*a*", 35*b*", 36" in which the bottom portions of 38*a*", 38*a*", and 39*a*" each include a locking structure-engaging area 48" (or opening) which is configured to align with a pair of coaxial openings 48" of the post sections 30", 35*a*", and 35*b*", respectively. In the embodiment shown, sets of coaxial openings 48" are engaged by a removable pin or pin-like structure 49". As shown, in such embodiments, the post sections 30", 35*a*", 35*b*", 36" may include only two rows 32*a*", 32*b*" of coaxial openings 48". In the embodiment shown, the pins or pin-like structures 49" may have a threaded portion to be secured in a respective pair of openings using a bolt with an optional washer. In further embodiments, the pin or pin-like structures 49" may have a curved or bent end such that the pin or pin-like structures 49" must be twisted to pass through a respective pair of openings 48" and is twisted again to be secured in place. In still further embodiments, the pins or pin-like structures 49" may have alternative configurations and/or structures such as is known in the art to provide a secure and releasable connection between post segments 30", 35*a*", 35*b*", 36".

Figure 9A:
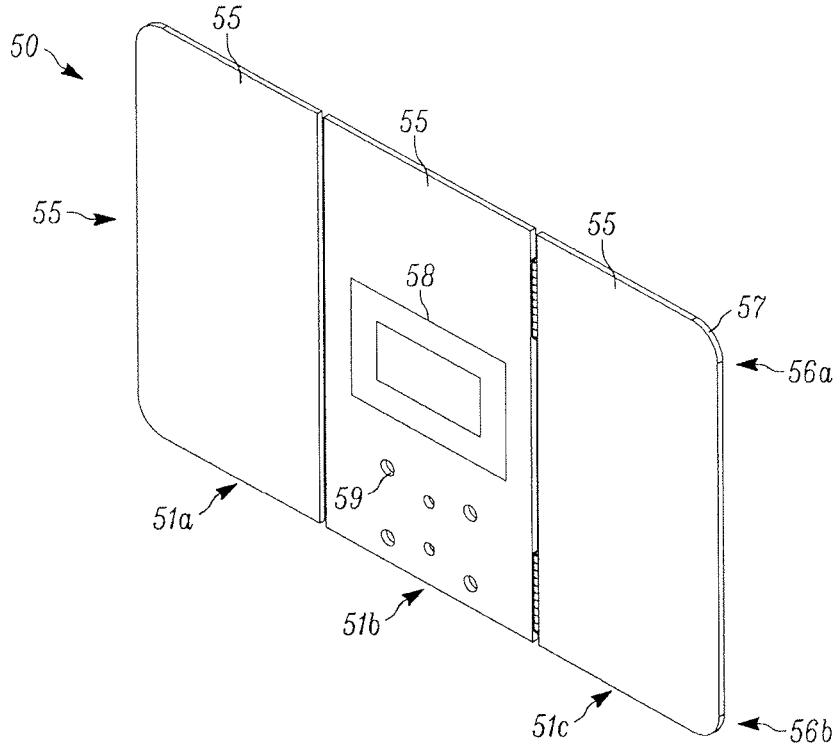
FIG. 9A is a perspective view of a backboard for a portable basketball hoop in the open position in accordance with embodiments of the present disclosure.
Figure 9B:
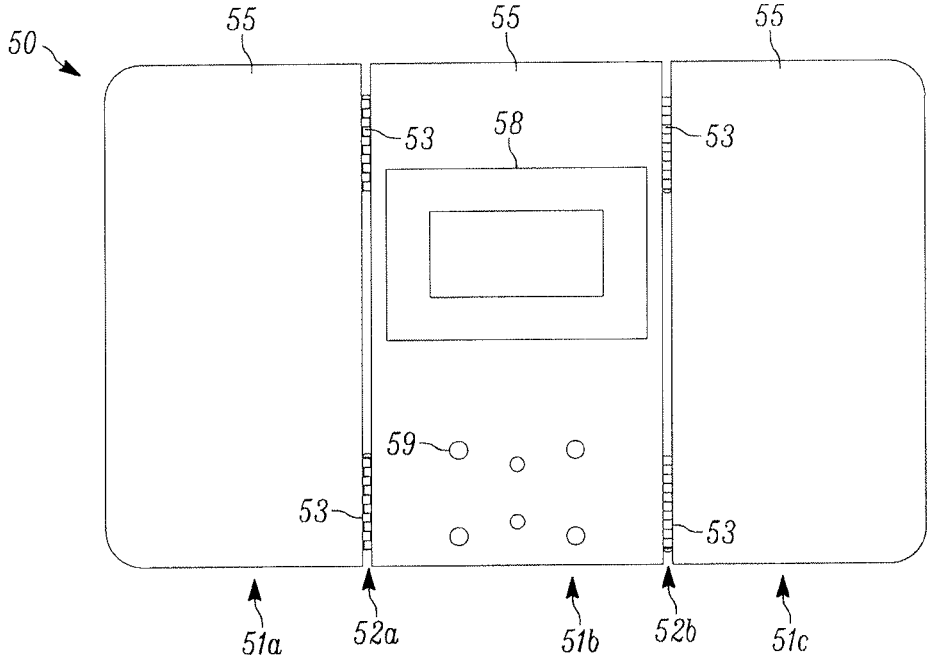
FIG. 9B is a front view of a backboard for a portable basketball hoop in the open position in accordance with embodiments of the present disclosure.
Figure 9C:
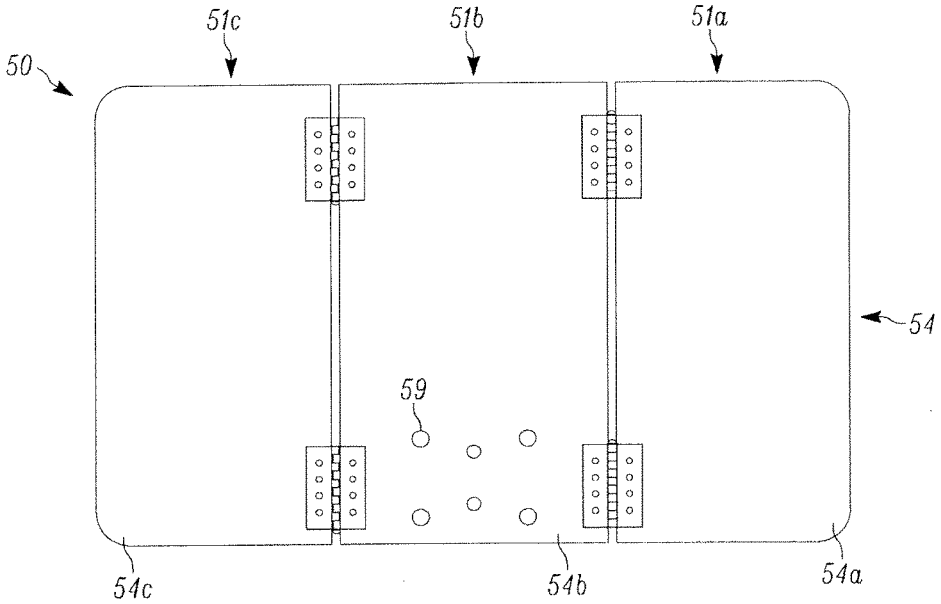
FIG. 9C is a back view of a backboard for a portable basketball hoop in the open position in accordance with embodiments of the present disclosure.
Figure 10A:
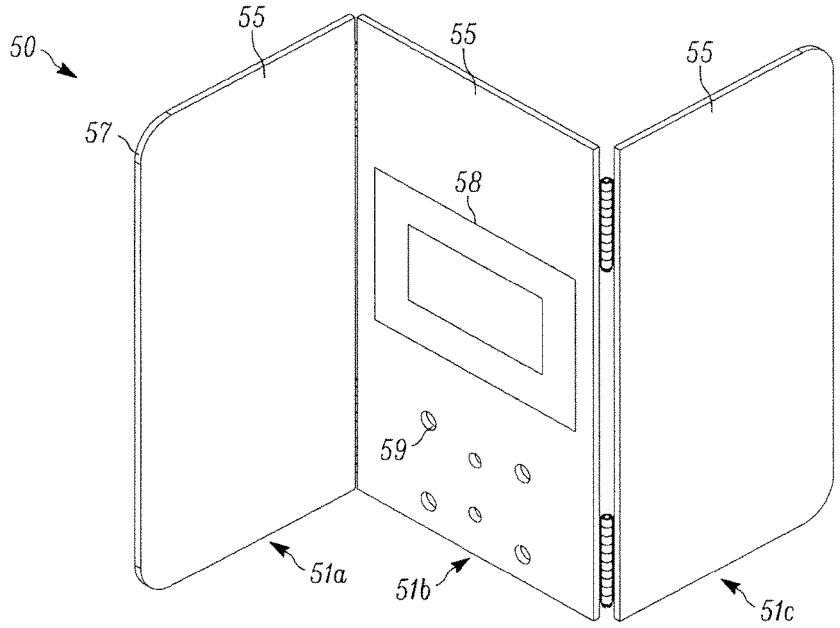
FIG. 10A is a perspective view of a backboard for a portable basketball hoop in a partially folded position in accordance with embodiments of the present disclosure.
Figure 10B:
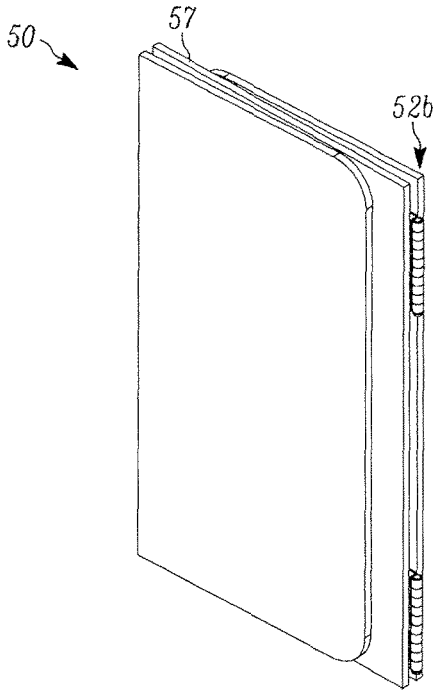
FIG. 10B is a perspective view of a backboard for a portable basketball hoop in a folded position in accordance with embodiments of the present disclosure.
Figure 10C:
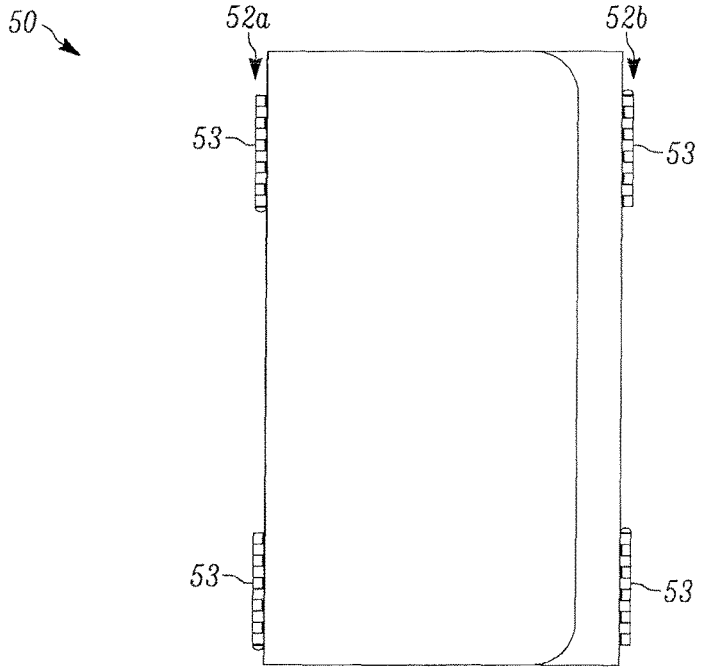
FIG. 10C is a back view of a backboard for a portable basketball hoop in folded position in accordance with embodiments of the present disclosure.

FIGS. 9A-9C show a backboard 50 for a portable basketball hoop 100 in the open position, while FIGS. 10A-10C show the backboard 50 in a partially folded or folded position.

As shown in FIGS. 9A-9C, the backboard 50 is composed of three panel portions—two side portions 51*a*, 51*c* and a middle portion 51*b*. The panels 51*a*, 51*b*, 51*c* are connected by hinged seams 52*a*, 52*b* which permit the side panels 51*a*, 51*c* to pivot relative to the middle portion 51*b*. In the exemplary embodiment shown, the hinged seams 52*a*, 52*b* each include at least one, preferably two, hardware components 53 which permit the pivoting of the side panels 51*a*, 51*c* in a range of 180 degrees. For example, in the embodiment shown, some of the hardware components 53*a* are barrel hinges, while same hardware components 53*b* are cup hinges. However, in further exemplary embodiments, the hardware components 53 may be any hinge structure permitting the pivoting of side panels 51*a*, 51*c* in the necessary 180 degree range, including, but not limited to, a barrel hinge, a pivot hinge, a butt/mortise hinge, a case hinge, a continuous hinge, a piano hinge, a concealed hinge, a butterfly hinge, a flag hinge, an H hinge, an HL hinge, a flush hinge, a coach hinge, a counterflap hinge, a rising butt hinge, a tee hinge, a friction hinge, a security hinge, a self-closing hinge, and combinations thereof.

In an embodiment, the hinged seams 52*a*, 52*b* are approximately parallel, or parallel, to one another. In a further embodiment, the hinged seams 52*a*, 52*b* are perpendicular to an edge of the backboard 50.

In still a further embodiment, in addition to the hardware components 53 which form the hinges of the hinged seams 52*a*, 52*b*, the backboard 50 may include additional locking components to secure the panels 51*a*, 51*c* in their open position.

In the embodiment shown, the hardware components 53 are provided on the back 54 of the backboard 50. Similarly, in embodiments employing locking components to secure the panels 51*a*, 51*c* in the open position, the locking components are preferably provided no the back 54 of the backboard 50. By providing the hardware components 53 on the back 54 of the backboard 50, the front 55, or playing surface, of the backboard 50 is flat and free from protruding structures which could alter the direction of a basketball on a rebound. However, in further exemplary embodiments, one or more hardware structures 53, or, in some embodiments, locking structures, may be provided on the front 55 of the backboard 50. In such embodiments, the hardware components 53 and/or locking components are positioned toward the top 56*a* and/or bottom 56*b* of the backboard 50 in order to prevent as little play interference as possible.

In the exemplary embodiment shown, and with particular reference to FIGS. 10A-10C, one side panel 51*a* is configured to fold to the front 55 of the backboard 50, while the other side panel 51*c* is configured to fold to the back 54 of the backboard 50. This folding arrangement is typically referred to as a Z-fold. Because the backboard 50 has a thickness 57, using a Z-fold is preferably over other folds, such as, for example, a C-fold or other folding style which would require the panels 51*a*, 51*c* to overlap. It will be understood that when the backboard 50 is folded such that panels 51*a*, 51*c* would overlap, whichever panel would be on top would either not lay flat due to the backboard's thickness 57 or need to separate from the middle panel 51*b* by a distance equivalent to the thickness 57 of the backboard 50. The Z-fold is therefore the preferred folding arrangement.

As illustrated in FIGS. 9A-10C, the backboard 50 has an open position (see FIGS. 9A-9C) and a closed position (see FIGS. 10A-10C). In the open position, the front surfaces 55*a*, 55*b*, 55*c* of the panels 51*a*, 51*b*, 51*c* are coplanar, or substantially coplanar. In the closed position, the front surface 55*a* of the first outer panel 51*a* faces the front surface 55*b* of the middle panel 51*b* and the back surface 54*c* of the second outer panel 51*c* faces the back surface 54*b* of the middle panel 51*b*. In some embodiments, the front surfaces 55*a*, 55*b* may be in physical contact while in the folded position. Similarly, in some embodiments, the back surfaces 54*b*, 54*c* may be in physical contact while in the folded position. However, in some embodiments, the front surfaces 55*a*, 55*b* and/or back surfaces 54*b*, 54*c* may not be in physical contact in the folded position. For example, in some embodiments, depending on the hardware hinges used, it may not be possible for the front surfaces 55*a*, 55*b* and/or back surfaces 54*b*, 54*c* to be in physical contact in the folded position.

Again with reference to FIGS. 9A-9C, the middle panel 51*b* includes traditional basketball backboard markings 58, such as the rectangle behind the rim 70. In one embodiment, the marking 58 is a rectangle which complies with regulation guidelines. For example, the rectangle may have outer dimensions of 18 inches vertically and 24 inches horizontally. The rectangle may be created with a 2-inch wide marking. The rectangle may be level with the rim 70 such that the top edge of the bottom of the marking is on an even plane with the top of the rim 70 and the bottom edge of the bottom of the marking is 6 inches from the bottom 56*b* of the backboard 50.

In a further embodiment, such as that shown in FIGS. 9A-9C, the marking 58 may be a smaller rectangle or square which provides a more defined shooting target.

In further exemplary embodiments, the backboard 50 may include alternative or additional markings 58, including brand indicia, colors, patterns, and designs which are desirable by the players.

As shown in FIGS. 9B and 9C, and with further reference to FIGS. 5C-5E, the center panel 51*b* also includes a plurality of attachment points 59 which align with securing structures 43 of the back plate 42 of the post 40 and/or attachment points which align with securing structures 72 of the rim 70. In the exemplary embodiment shown, the attachment points 59 are a plurality of openings configured to receive bolts. When aligned with the back plate 42 of the post 40, the openings 59 of the backboard 50 align with the securing structures 43 (e.g., openings or cage nuts) in the back plate 42 to form sets of coaxial openings configured to receive a bolt.

In further embodiments, the backboard 50 may attach to the post 40 using other structures or components capable of providing a secure and stable releasable attachment. For example, clips, clamps, braces, brackets, and/or locking hardware may be used to releasably secure the backboard 50 and post 40.

In the exemplary embodiment shown, the backboard 50 is generally rectangular with each of the panels 51*a*, 51*b*, 51*c* being approximately equal in dimension. In further embodiments, panels 51*a*, 51*c* are smaller in width than the center panel 51*b* against which the outer panels 51*a*, 51*c* are folded.

In an embodiment, the backboard 50 meets with regulation guidelines. For example, in an embodiment, the backboard 50 is 72 inches wide and 42 inches tall. However, in further embodiments, the backboard 50 may be smaller to improve the portability of the basketball hoop 100.

Figure 11A:
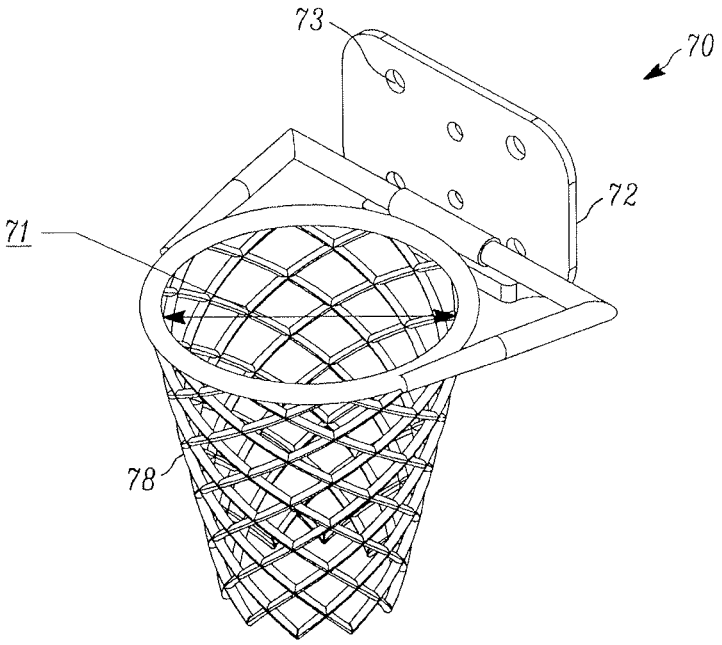
FIG. 11A shows the rim of a portable basketball hoop in accordance with embodiments of the present disclosure.
Figure 11B:
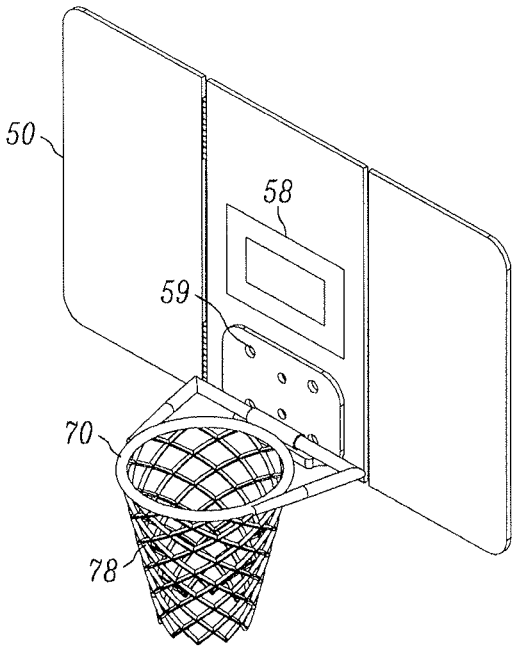
FIG. 11B shows the rim of a portable basketball hoop attached to the backboard in accordance with embodiments of the present disclosure.

With reference to FIGS. 11A-11B, a rim 70 of a portable basketball hoop 100 is shown. The rim 70 is a standard rim 70 having a diameter 71 which is approximately 18 inches to meet standard basketball regulations; however, rims 70 having different diameters are within the scope of this disclosure. The rim 70 has a base portion 72 including a plurality of attachment points 73 which correspond to attachment points 59 on the backboard and/or securing structures 43 of the post 40.

In the exemplary embodiment shown, the attachment points 73 are openings in the base portion 72 which correspond to openings 59 on the backboard 50 (and, in some embodiments, corresponding securing structures 43 on the post 40). In embodiments, the openings 59 on the backboard 50 which correspond with openings 73 in the rim 70 are configured to receive a bolt which is secured in place with a nut and, optionally, washer. In further embodiments, the attachment points 59 on the backboard 50 which correspond to the openings 73 on the rim 70 include cage nuts which are configured to secure a bolt which is passed through the openings 73 in the rim 70.

As described with reference to FIGS. 5C-5E, in some embodiments, the openings 73 in the rim 70 align with openings 59 in the backboard and securing structures 43 on the post 40. In such embodiments, the respective openings 73, 59 and securing structures 43 are coaxial. A bolt passed through the openings 73, 59 and securing structures 43 may be secured in position by a bolt and, optionally, washer, or other similar structure to releasably secure the rim 70, backboard 50 and post 40 together. Similarly, in embodiments in which the post securing structures 43 are cage nuts in the post 40, a bolt passed through the openings 73, 59 engages the securing structures 43 of the post 40 to releasably secure the rim 70, backboard 50 and post 40 together.

Although the attachment of the post 40, backboard 50 and rim 70 are described with reference to bolt/nut attachment hardware, it will be understood that alternative means of releasably securing the post 40, backboard 50 and rim 70 may be useful in the portable basketball hoop 100. For example, means of releasably securing the post 40, backboard 50 and/or rim 70 which do not require additional hardware (e.g., friction fits or other structures provided on the elements of the portable basketball hoop 100 such as clamps, clips, and/or locking structures) may be used to reduce the number of pieces which need to be assembled/disassembled and stored.

Figure 12A:
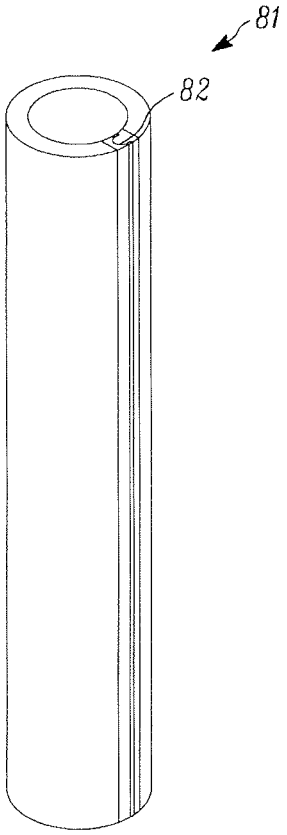
FIG. 12A illustrates an exemplary padding section which may be placed around a portion of a post of a portable basketball hoop in accordance with embodiments of the present disclosure.
Figure 12B:
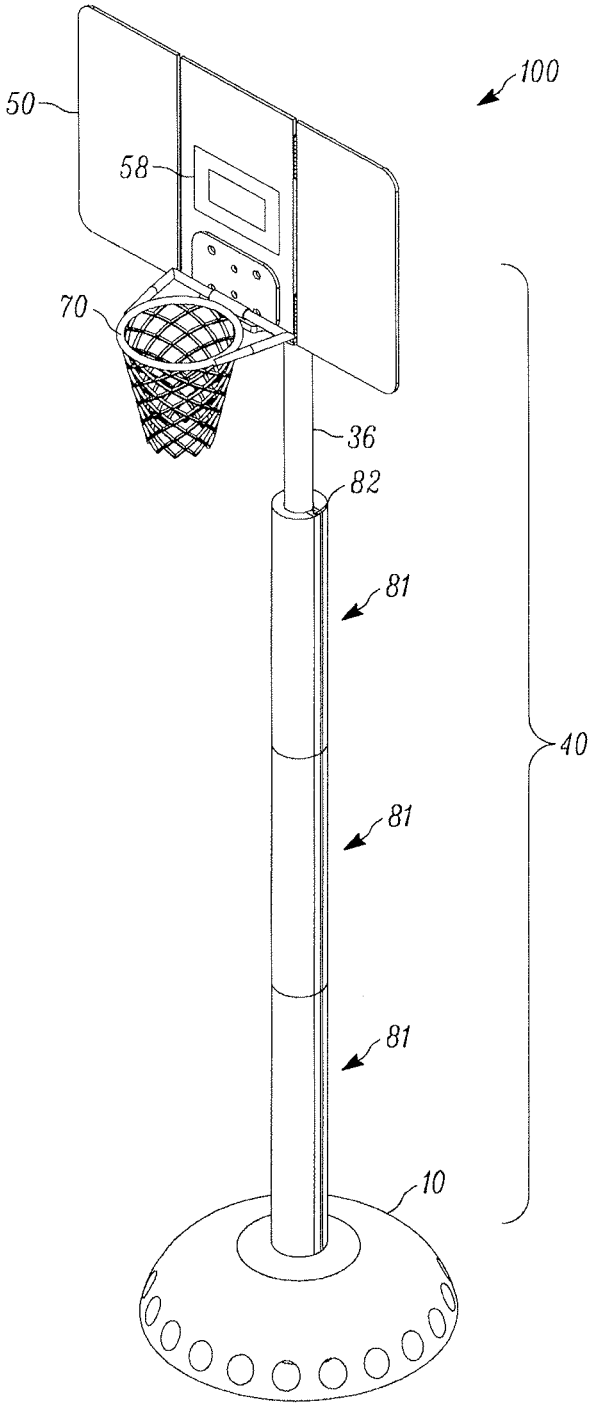
FIG. 12B illustrates an exemplary portable basketball hoop with padding on a portion of the post in accordance with embodiments of the present disclosure.
Figure 13A:
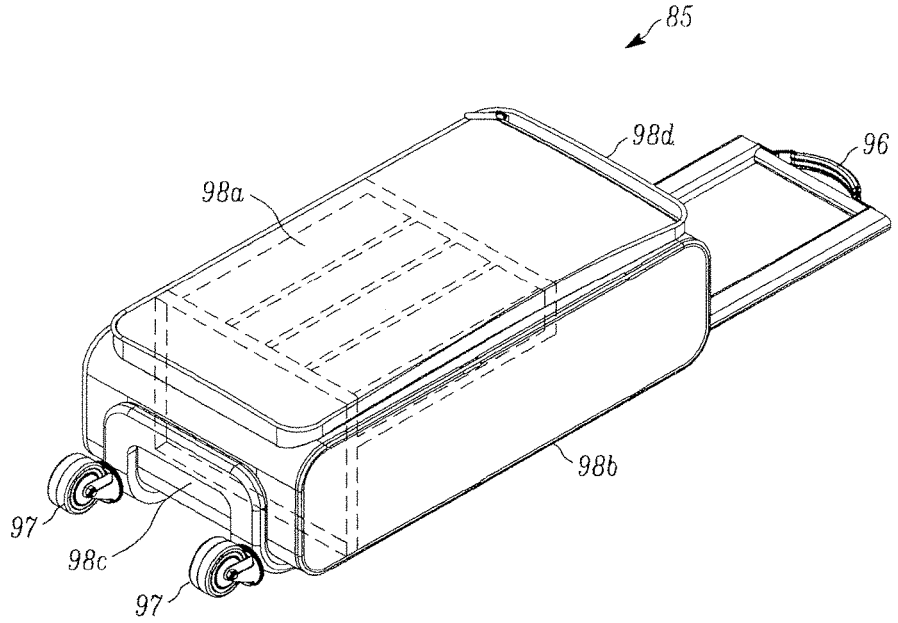
FIG. 13A is a perspective view of an exemplary travel bag for storing and transporting a portable basketball hoop in accordance with embodiments of the present disclosure.
Figure 13B:
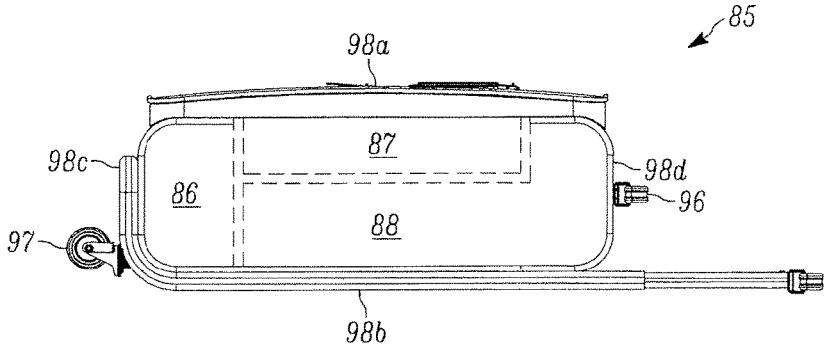
FIG. 13B is a side view of an exemplary travel bag for storing and transporting a portable basketball hoop in accordance with embodiments of the present disclosure.
Figure 14:
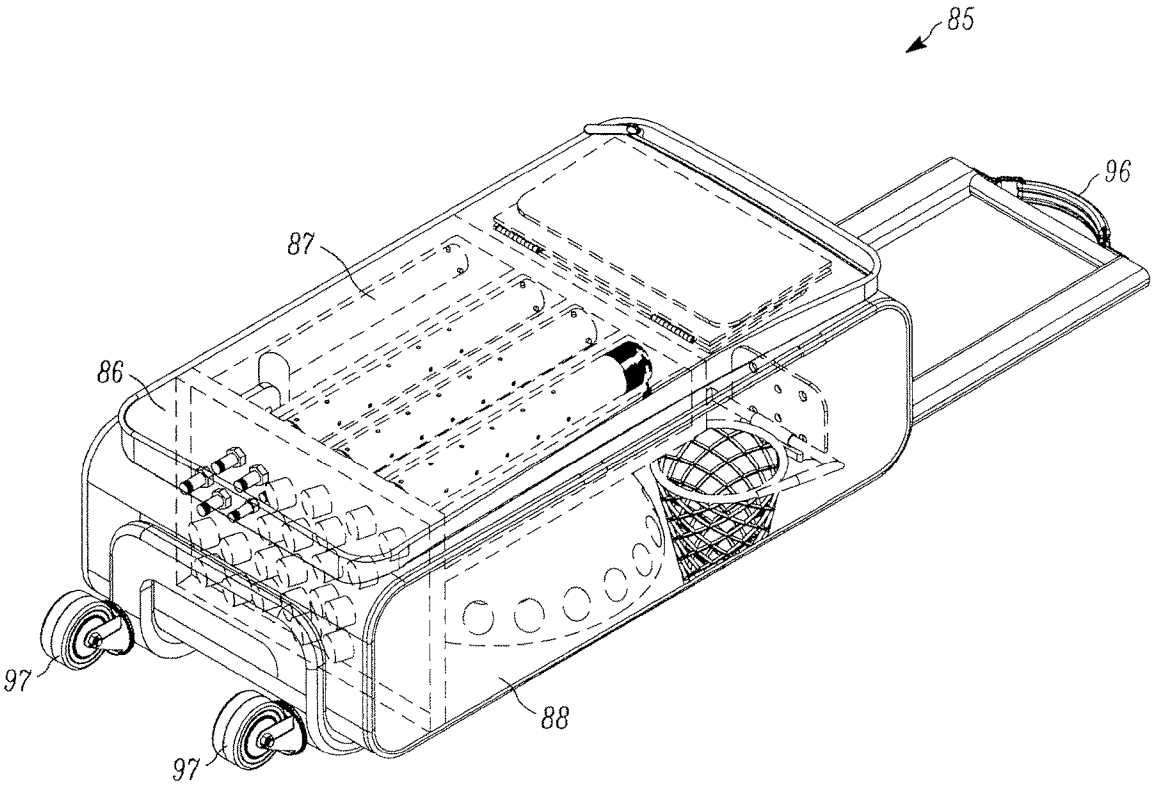
FIG. 14 shows an exemplary travel bag for storing and transporting a portable basketball hoop with the disassembled portable basketball hoop shown in phantom in the travel bag in accordance with embodiments of the present disclosure.
Figure 15:
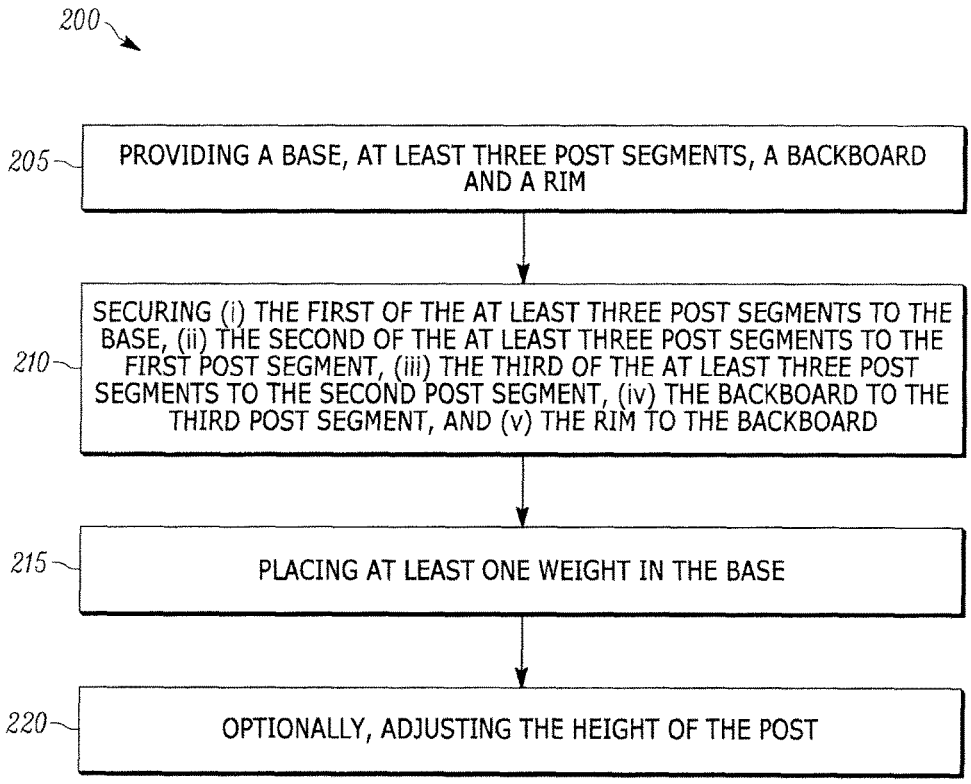
FIG. 15 is an exemplary flowchart outlining a method of erecting a portable basketball hoop in accordance with embodiments of the present disclosure.

In some embodiments, the basketball hoop 100 may include additional components, or accessories, including, but not limited, padding sections 81 (see FIGS. 12A-12B), a net 78 for the rim 70 (see FIGS. 1A-1D), weights 20 (see FIGS. 2A-2B), additional/replacement hardware components (e.g., bolts, nuts, hinges, locks, etc.), assembly tools, and carrying packs 85 (see FIGS. 13A-14).

FIGS. 12A-12B show exemplary padding 81 for a portable basketball hoop 100. One exemplary padding section 81 is shown in FIG. 12A as being a foam structure lined with a water-resistant material. However, in further embodiments, the padding section 81 may be any material known in the art to provide some form of cushioning effect around the post 40. Preferably, the material used to form padding sections 81 has an outer surface which is water resistant and easy to clean and maintain.

The padding section 81 may be rolled into a tube-like structure and secured around at least a portion of the post 40 using attachment structure 82, such as shown in FIG. 12B. In the embodiment shown, the attachment structure 82 is a hook-and-loop fastener running the length of the padding section 81. However, in further embodiments, the padding sections 81 may include snaps, hooks, hook-and-eye structures, buttons or any combination of such structures to releasably secure around a portion of a post 40. In further embodiments, a padding section 81 may be a tubular structure which is slid on the post 40 or at least a section of the post 40 prior to assembling the post 40.

In the exemplary embodiment shown in FIG. 12B, three padding sections 81 are provided—one section 81 corresponding to each of the post segments 31, 35*a*, 35*b*. However, in further embodiments, including, for example, when the post 40 is provided at heights different than that shown, any number of padding sections 81 may be used. It is further understood that padding sections 81 of different lengths may be used depending on the overall length of the post 40 after it is fully assembled and secured at a given height.

FIGS. 13A-13B show an exemplary travel bag 85 which is customized to store and provide transport for a portable basketball hoop 100. In the embodiment shown, the travel bag 85 has a top 98*a*, bottom 98*b*, front 98*c*, and back 98*d*, with wheels 97 at the bottom 98*b* of the bag 85 and a retractable handle 96 at the top of the bag 85. In the exemplary embodiment shown, the bag 85 includes three main compartments. A first hard-bottom compartment 86 is provided at the bottom of the bag 85. A middle or second compartment 87 is generally disposed at the middle in the front 98*c* portion of the bag 85. A third compartment is provided at the back 98*d* of the bag 85.

In the exemplary embodiment shown, the bag 85 includes two wheels 97, with the bag 85 intended to be tipped towards the individual pulling the bag 85 when it is rolling. However, in further embodiments, the bag 85 may be configured with additional wheels 97 (e.g., four wheels) so that the bag 85 may remain upright when being rolled. In some embodiments, the wheels 97 may be provided as casters. The casters may be rigid casters and/or swivel casters, depending on the configuration of the travel bag 85. For example, in some embodiments, the travel bag 85 may be configured similar to a traditional two-wheeled suitcase which is tipped to roll. In such embodiments, rigid casters may be used. In other embodiments, however, including, for example, those in which a travel bag 85 includes four wheels so as to be rolled in an upright position on all four wheels, swivel casters may be used.

In the embodiment shown, and with reference now to FIG. 14, the first compartment 86 is specifically designed to secure weights 20 which may be used with the portable basketball hoop 100. Other hardware components such as bolts, screws, nuts, washers, pins, etc. may be stored in the first compartment 86.

As shown, the first compartment 86 has a hard bottom 88*a* and a hard top divider portion 88*b* which separates the first compartment 86 from the second compartment 87. The hard bottom and top surfaces 88*a*, 88*b* add strength to the compartment 86 which may hold a significant amount of weight. In some embodiments, the sides of the first compartment 86 may also be hard.

A second compartment 87 is disposed generally about the middle front section of the bag 85 and specifically designed to carry the post segments 31, 35*a*, 35*b*, 36 and padding sections 81 if used. For example, the second compartment 87 may include partitions to keep the post segments 31, 35*a*, 35*b*, 36 separated and prevent them from rolling in the bag 85. In some embodiments, the padding sections 81 may be stored around the respective post sections 31, 35*a*, 35*b*, 36 to use the interior space of the bag 85 efficiently.

In an embodiment, a third compartment 90 is provided which extends from the top 98*a* of the bag 85 along the back 98*d* of the bag 85. In one embodiment, the third compartment 90 extends from the top 98*a* of the bag 85 to the start of the first compartment 86. In another embodiment, the third compartment 90 extends from the top 98*a* of the bag 85 along the entire back 98*d* of the bag 85. The third compartment 90 is specifically designed to carry the folded backboard 50 and base 10. The third compartment 90 therefore has dimensions sufficient to fit both the folded backboard 50 and base 10.

The rim 70 may be stored in any section in which it fits, along with any remaining components, such as a net 78.

Although the bag 85 is described with reference to FIGS. 13A-14 as having three compartments, each of which is specifically configured to secure and transport specific components of the basketball hoop 100, it is understood that the bag may take different shapes, sized or configurations while retaining the ability to secure a portable basketball hoop 100 for transport. For example, in one embodiment, the entire bag 85 may be hard-walled. In further embodiments, the bag 85 may be entirely soft-walled and more similar to a duffle bag. Moreover, in the embodiment shown, the bag 85 has a generally vertical arrangement, meaning the bag 85 is taller than it is wide when being rolled along on its wheels 97. In further embodiments, the bag 85 may have a generally horizontal arrangement similar to a "rolling duffle," such that the bag 85 is longer than it is tall when being rolled along on its wheels 97.

In further embodiments, the bag 85 may include additional compartments which facilitate or enhance the ability of a single, or few, individual to transport the bag 85 and portable basketball hoop 100. For example, in an embodiment, the bag 85 may include an additional compartment which, when fully unzipped, provides a protective surface over a portion of the bag. For example, a small pocket at the front or back of the bag 85 may fully unzip, expand, and, in some embodiments, secure between or over the wheels 97 of the bag 85 to provide a smooth and protective barrier over a surface of the bag 85 so that the bag 85 may be more easily pulled up and/or down stairs. In some embodiments, such a smooth and protective barrier may also prevent damage to the bag 85 and/or other items, such as cars, when the bag 85 is being transported (e.g., put into/taken out of a car trunk).

It will be understood that the design of the portable basketball hoop 100 and the ability to disassemble the basketball hoop 100 into portions capable of fitting in the travel bag 85 for transport makes the portable basketball hoop 100 easy to move and assemble in different locations.

In keeping with at least some of the advantages of the present portable basketball hoop 100 as described herein, it is desirable to form each of the components of the basketball hoop 100 out of a lightweight material which is still strong enough to provide a stable system. For example, in an embodiment, the base 10 may be formed from lightweight and durable plastic or composite material. Similarly, in an embodiment, the post segments may be formed from a lightweight and durable plastic or composite material. In further embodiments, such as, for example, to provide additional strength, the post segments may be made from metal. Because the post segments are hollow, using metal for the post segments does not impose a significant increase in weight of the overall system.

In an embodiment, the backboard 50 may be formed from a lightweight and durable plastic like the base 10. In still further embodiments, the backboard 50 may be clear (transparent), translucent, or opaque. In still further embodiments, the backboard 50 may be solid or hollow.

In an embodiment, the rim 70 may be made from a lightweight durable plastic or composite material. In a further embodiment, the rim 70 may be made from metal. Because the rim 70 is but a small portion of the portable basketball hoop 100, suing metal for the rim 70 does not result in a significant weight increase.

In an embodiment, the hardware components used to join the various components of the basketball hoop 100 are primarily metal. Metal hardware is more durable than hardware made from other materials (e.g., plastic) and lasts longer with repeated use (e.g., assembly/disassembly of the basketball hoop 100).

Further disclosed herein is a method 200 for assembling a portable basketball hoop. In one embodiment, the method first includes providing a base, at least three post segments, a backboard and a rim (step 205).

In an embodiment, the base may be a base 10 according to any one or more of the embodiments described herein. For example, in an embodiment, the base 10 includes a flat bottom surface and an upper surface with an opening including an internal structure, such as internal threads.

In an embodiment, the at least three post segments includes a bottom post segment, at least one middle post segment, and a top post segment.

In an embodiment, the bottom post segment may be a bottom post segment 31 according to any one or more of the embodiments described herein. For example, in an embodiment, the bottom post segment comprises a body portion with a plurality of openings arranged in at least two rows and a bottom section including an external structure, such as external threads. In the embodiment, each row has the same number of openings and the openings in the first row each have a corresponding opening in the second row such that the corresponding openings are in the same plane. In a further embodiment, the corresponding openings are coaxial.

In an embodiment in which more than two rows of openings are provided on the first post segment, the further rows of openings also include the same number of openings as the first and second rows, and corresponding openings occur in the same plane.

In an embodiment, the at least one middle post segment is such as described with reference to middle post segments 35*a*, 35*b*, above. For example, in an embodiment, the second post segment comprises a bottom portion with at least two opening-engaging structures and a body portion. Each opening-engaging structure corresponds to one of the rows of openings of the first post segment. In an embodiment, the opening-engaging structures are pins, such as described with reference to FIGS. 5A-5H, above.

The body portion includes a plurality of openings arranged in at least two rows. In an embodiment, the rows have the same number of openings and the openings in the first row have a corresponding opening in the second row such that the corresponding openings are in the same plane. In a further embodiment, the corresponding openings are coaxial.

In an embodiment in which more than two rows of openings are provided on the second post segment, the further rows of openings also include the same number of openings as the first and second rows, and corresponding openings occur in the same plane.

In an embodiment, two or more middle post segments are provided. In an embodiment, the two middle post segments are such as described with reference to post segments 35*a*, 35*b*, above.

In an embodiment, the top post segment 36 is such as described with reference to FIGS. 5A-5H. For example, in an embodiment, the third or top post segment comprises a bottom portion with at least two opening-engaging structures and a top portion. The opening-engaging structures each correspond to one of the rows of openings in the second post segment. In an embodiment, the opening-engaging structures are pins, such as described with reference to FIGS. 4A-4H, above.

In an embodiment, the method further includes providing a backboard. In an embodiment, the backboard is a backboard 50 according to any one or more of the embodiments described herein.

In an embodiment, the method further includes providing a rim. In an embodiment, the rim is a rim 70 according to any one or more of the embodiments described herein.

In an embodiment, the method further includes a next step 210 of securing (i) a first of the at least three post segments (e.g., bottom post segment) to the base, (ii) a second of the at least three post segments (e.g., a middle post segment) to the first post segment (e.g., bottom post segment), (iii) a third of the at least three post segments (e.g., top post segment) to the second post segment (e.g., middle post segment), (iv) the backboard to the third post segment (e.g., top post segment), and (v) the rim to the backboard. In an embodiment in which more than one middle post segment is provided, the substep (ii) of securing the second post segment to the first post segment comprises (ii.a) securing a first middle post segment to the first (e.g., bottom) post segment, (ii.b) securing a second middle post segment to the first middle post segment, and so on until each of the middle post segments are secured to one another.

It will be understood that the step of securing the post segments, backboard and rim to one another (e.g., substeps (i)-(v), above) may occur in any order. For example, in an embodiment, the order of securing the components to one another may be influenced by the total height of the post, the size and/or strength of the person assembling the portable basketball hoop, and/or the availability of a ladder or other similar structure.

For example, in an embodiment, the components may be secured to one another in a "bottom-up" fashion. That is, in an embodiment, the first (e.g., bottom) post segment is first secured to the base, the second (e.g., middle) post segment is then secured to the first post segment, the third (e.g., top) post segment is then secured to the second post segment, the backboard is secured to the third post segment, and the rim is then secured to the backboard. Similarly, when two (or more) second (e.g., middle) post segments are provided, after the first (e.g., bottom) post segment is secured to the base, the first middle post segment is secured to the first post segment, the second middle post segment is then secured to the first middle post segment and so on until each of the middle post segments are secured to their respective previous middle post segment, and the third (e.g., top) post segment is then secured to the last of the middle post segments. The backboard and rim are then secured as described above. It will be understood that the rim may be connected to the backboard before or after the backboard is connected to the third (e.g., top) post segment.

However, in further embodiments, it may be desirable to assemble the portable basketball hoop in sections. That is, in an embodiment, for example, the first (e.g., bottom) post segment may be secured to the base. Separately, the rim may be secured to the backboard. The backboard with rim may then be secured to the third (e.g., top) post segment. The third post segment may then be secured to the second (e.g., middle) post segment and the second post segment (with the third post segment, backboard and rim attached) then secured to the first post segment. Alternatively, the second (e.g., middle) post segment may be secured to the first post segment and the third post segment (with the backboard and rim attached) then secured to the second post segment.

When more than one second (e.g., middle) post segment is provided, the middle post segments may be connected to each other separately and then connected to the first (e.g., bottom) post segment and third (e.g., top) post segment in either order. For example, when two middle post segments are provided, the first (e.g., bottom) post segment may be secured to the base. Separately, the rim may be secured to the backboard. The backboard with rim may then be secured to the third (e.g., top) post segment. The two middle post segments may then be separately secured to one another. The third post segment may then be secured to the middle post section (comprising two middle post segments) and the middle post section (with the third post segment, backboard and rim attached) then secured to the first post segment. Alternatively, the middle post section (comprising two middle post segments) may be secured to the first post segment and the third post segment (with the backboard and rim attached) then secured to the middle post section. Further still, the two middle post segments may be secured to the first (e.g., bottom) and/or third (e.g., top) post segments (before or after the first post segment is secured to the base and/or the backboard is secured to the third post segment), and the two middle post segments then secured to one another.

In still further embodiments, the at least three post segments may be secured to each other (before or after the first post segment is secured to the base) such that the second (e.g., middle) post segment engages the lowest openings of the first (e.g., bottom) post segment and the third (e.g., top) post segment engages the lowest openings of their respective corresponding post segment. In that way, the post is in the shortest position permitted by the arrangement of the openings on the body portions of the respective post segments. When in this shortest position, the backboard (with or without the rim attached) may be attached to the third (e.g., top) post segment. When more than one second (e.g., middle) post segments is provided, the middle post segments may be similarly secured with the first post segment, third post segment and each other so as to be in the shortest position permitted.

The backboard and rim may then be secured to the third post segment and the individual post segments adjusted (e.g., by raising one or more post segments to a higher set of openings) to achieve a desired post height.

In an embodiment, the step of securing the first (e.g., bottom) post segment to the base comprises engaging corresponding threads such as described, for example, with reference to FIGS. 3A-3C, above.

In an embodiment, the step of securing the second (e.g., middle) post segment to the first post segment comprises engaging the opening-engaging structures of the second post segment with a pair of corresponding openings in the first post segment.

In an embodiment, such as, for example, when more than one second (e.g., middle) post segment is provided, the step of securing a first middle post segment to a second middle post segment comprises engaging the opening-engaging structures of a second middle post segment with a pair of corresponding openings in a first middle post segment.

In an embodiment, the step of securing the third (e.g., top) post segment to the second post segment (or middle post section) comprises engaging the opening-engaging structures of the third post segment with a pair of corresponding openings in the second post segment (or middle post section). In an embodiment, the step of securing the third post segment to the second post segment (or middle post section) uses the same structures and substeps as the step of securing the second post segment to the first post segment.

In an embodiment, the step of securing a backboard to the third post segment comprises securing the backboard to a top portion of the third post segment.

In an embodiment, the method further includes the steps of placing at least one weight in the base (215) and/or adjusting the height of the post (220).

In one embodiment, the step of adjusting the height of the post includes selecting a corresponding pair of openings one post segment (e.g., the first post segment or second post segment) and securing another post segment (e.g., the second post segment or third post segment) at the selected pair of openings. In an embodiment, the step of adjusting the height of the post includes selecting a corresponding pair of openings of the first (e.g., bottom) post segment and securing the second (e.g., middle) post segment at the selected pair of openings and/or selecting a corresponding pair of openings in the second (e.g., middle) post segment and securing the third (e.g., top) post segment at the selected pair of openings. In an embodiment, such as, for example, when more than one second (e.g., middle) segment is provided, the stop of adjusting the height of the post may include selecting a corresponding pair of openings in a first middle segment and securing a second middle segment at the selected pair of openings.

In another embodiment, the step of adjusting the height of the post includes selecting a corresponding pair of openings in the first post segment and a corresponding pair of openings in the second post segment, securing the second post segment in the first post segment at the corresponding selected pair of openings and securing the third post segment in the second post segment at the corresponding selected pair of openings. In embodiments in which more than one second (e.g., middle) post segment are provided, the step of adjusting the height of the post includes selecting a corresponding pair of openings in each of the middle post segments, securing a second middle post segment in the first middle post segment at the corresponding pair of openings in the first middle post section and securing the third post segment in the second middle post segment at the pair of corresponding openings in the second middle post segment.

In an embodiment, the method further includes providing a folded backboard, unfolding the backboard to expose at least one attachment point and securing the backboard to the top portion of the third post segment at the at least one attachment point. In an embodiment, the backboard may be a backboard 50 according to any one or more embodiments described herein.

In an embodiment, the method further includes providing a base comprising a bottom surface having a perimeter and a plurality of openings positioned around the perimeter. In an embodiment, the method further includes placing at least one weight in at least one of the plurality of openings positioned around the perimeter of the base.

Any statements provided regarding improvements or other features which may provide improved safety are not intended to guarantee, warrant or represent the safety of the portable basketball hoop disclosed herein.

The numerical ranges disclosed herein include all values from, and including, the lower value and the upper value. For ranges containing explicit values (e.g., 1 or 2, or 3 to 5, or 6, or 7) any subrange between any two explicit values is included (e.g., 1 to 2; 2 to 6; 5 to 7; 3 to 7; 5 to 6; etc.).

Among other things, it should be appreciated that the scope of the present disclosure is not limited to the number of constituting components, the materials thereof, the shapes thereof, the relative arrangement thereof, etc., as described above, but rather the above disclosures are simply provided as example embodiments.

Thus, it is specifically intended that the present invention not be limited to the embodiments and illustrations contained herein, but include modified forms of those embodiments including portions of the embodiments and combinations of elements of different embodiments as come within the scope of the following claims.

What is claimed is:

1. A portable basketball hoop comprising:

a hemispherical base having a bottom surface with a perimeter, a plurality of weight-receiving openings circumferentially positioned and equally spaced around at least a portion ⅔ of the perimeter adjacent to the bottom surface, and an upper surface with a centrally-located opening;

a post comprising:

a bottom segment having a bottom portion which engages the hemispherical base at the opening of the upper surface, and a body portion comprising a plurality of locking structure-engaging areas arranged in at least two rows, wherein each of the rows includes the same number of locking structure-engaging areas and each locking structure-engaging area in one of the at least two rows has a corresponding locking structure-engaging area in the second of the at least two rows, thereby forming a plurality of pairs of locking structure-engaging areas wherein the locking structure-engaging areas of a given pair are at the same height, at least one middle segment having a body portion comprising a plurality of locking structure-engaging areas arranged in at least two rows, wherein each of the rows includes the same number of locking structure-engaging areas and each locking structure-engaging area in one of the at least two rows has a corresponding locking structure-engaging area of the second of the at least two rows, thereby forming a plurality of pairs of locking structure-engaging areas wherein the locking structure-engaging areas of a given pair are at the same height, an upper segment having an upper portion having a back plate, wherein the back plate includes at least one securing structure, and at least two locking structures, each locking structure corresponding to one of the pairs of locking structure-engaging areas of the bottom segment and the at least one middle segment;

a backboard comprising two outer sections hingedly connected to a middle section, the two outer sections and middle section each having a front surface, wherein the two outer sections are hingedly moveable relative to the middle section such that the backboard has an open position and a folded position, wherein the front surfaces of the two outer sections and middle section are coplanar the backboard is in the open position, and wherein the middle section includes at least one attachment point corresponding to the at least one securing structure of the back plate; and a rim comprising at least one attachment point corresponding at least one of (i) the at least one attachment point of the middle section of the backboard, and (ii) the at least one securing structure of the back plate.

2. The portable basketball hoop of claim 1, wherein the locking structure-engaging areas are openings and the locking structures are opening-engaging structures.

3. The portable basketball hoop of claim 2, wherein the opening-engaging structures are pins.

4. The portable basketball hoop of claim 3, wherein the post comprises at least four pins, the at least one middle segment and the upper segment of the post each comprise a bottom portion, at least two of the pins are secured to the bottom portion of the at least one middle segment such that each of the pins corresponds to one of the rows of openings on the bottom segment, and at least two of the pins are secured to the bottom portion of the upper segment such that each of the pins corresponds to one of the rows of openings on the at least one middle segment.

5. The portable basketball hoop of claim 3, wherein the post comprises at least two middle segments, each middle segment comprising a bottom portion having at least two pins and a body portion comprising a plurality of openings arranged in at least two rows, wherein the at least two pins of the first middle segment correspond to the at least two rows of openings on the bottom segment and wherein the at least two pins of the second middle segment correspond to the at least two rows of openings of the first middle segment.

6. The portable basketball hoop of claim 2, wherein the at least one middle segment and the upper segment of the post each comprise a bottom portion having at least two openings, each opening corresponding to one of the rows of openings in the bottom post segment and middle post segment, respectively, such that when the openings on a bottom portion of the at least one middle segment and the openings on the bottom portion of the upper segment are aligned with a pair of openings in the bottom segment and middle segment, respectively, the openings are coaxial.

7. The portable basketball hoop of claim 6, wherein the locking structures are pins configured to engage the coaxial openings.

8. The portable basketball hoop of claim 1, wherein the locking structure-engaging areas are female interrupt threads and the locking structures are male interrupt threads.

9. The portable basketball hoop of claim 1, wherein the upper portion of the upper segment is at an angle of at least 20 degrees relative to the post.

10. The portable basketball hoop of claim 9, wherein the upper portion of the upper segment is at an angle of from 20 degrees to 80 degrees relative to the post.

11. The portable basketball hoop of claim 10, wherein the upper portion of the upper segment is at an angle of from 30 degrees to 65 degrees.

12. The portable basketball hoop of claim 1, wherein the back plate comprises a plurality of securing structures.

13. The portable basketball hoop of claim 12, wherein the middle section of the backboard comprises a plurality of attachment points, wherein at least one of the attachment points corresponds to at least one of the plurality of securing structures of the back plate.

14. The portable basketball hoop of claim 13, wherein the rim comprises at least two attachment points wherein at least one of (i) the at least two attachment points correspond to at least two of the plurality of attachment points of the middle section of the backboard other than the at least one attachment points of the middle section of the backboard corresponding to the at least one of the plurality of securing structures of the back plate, or (ii) at least two of the plurality of attachment points of the middle section of the backboard correspond to at least two of the plurality of securing structures of the back plate and the at least two attachment points of the rim correspond to the at least two of the plurality of attachment points of the middle section and the at least two of the plurality of securing structures of the back plate.

15. The portable basketball hoop of claim 1, wherein the openings project radially within the hemispherical base.

16. The portable basketball hoop of claim 2, wherein the pairs of openings of the bottom segment and at least one middle segment are coaxial.

17. The portable basketball hoop of claim 2, further comprising at least two middle segments, each middle segment comprising a bottom portion having at least two opening-engaging structures and a body portion comprising a plurality of openings arranged in at least two rows, wherein each of the rows includes the same number of openings and each opening in one of the at least two rows has a corresponding opening in the second of the at least two rows, thereby forming a plurality of pairs of openings wherein the openings of a given pair are at the same height, wherein the opening-engaging structures of a first of the at least two middle segments correspond to the at least two rows of openings of the bottom segment, and wherein the opening-engaging structures of a second of the at least two middle segments correspond to the at least two rows of openings of the first middle segment.

18. A portable basketball hoop comprising:

a hemispherical base having a bottom surface with a perimeter, a plurality of weight-receiving openings circumferentially positioned and equally spaced around at least a portion ⅔ of the perimeter adjacent to the bottom surface, and an upper surface with a centrally-located opening;

a post comprising:

a bottom segment having a bottom portion which engages the hemispherical base at the opening of the upper surface, and a body portion comprising a plurality of locking structure-engaging areas arranged in at least two rows, wherein each of the rows includes the same number of locking structure-engaging areas and each locking structure-engaging area in one of the at least two rows has a corresponding locking structure-engaging area in the second of the at least two rows, thereby forming a plurality of pairs of locking structure-engaging areas wherein the locking structure-engaging areas of a given pair are at the same height, at least one middle segment having a body portion comprising a plurality of locking structure-engaging areas arranged in at least two rows, wherein each of the rows includes the same number of locking structure-engaging areas and each locking structure-engaging area in one of the at least two rows has a corresponding locking structure-engaging area of the second of the at least two rows, thereby forming a plurality of pairs of locking structure-engaging areas wherein the locking structure-engaging areas of a given pair are at the same height, an upper segment having an upper portion having a back plate, wherein the back plate includes at least one securing structure, and at least two locking structures, each locking structure corresponding to one of the pairs of locking structure-engaging areas of the bottom segment and the at least one middle segment;

a backboard comprising two outer sections hingedly connected to a middle section, the two outer sections and middle section each having a front surface, wherein the two outer sections are hingedly moveable relative to the middle section such that the backboard has an open position and a folded position, wherein the front surfaces of the two outer sections and middle section are coplanar the backboard is in the open position, and wherein the middle section includes at least one attachment point corresponding to the at least one securing structure of the back plate; and a rim comprising at least one attachment point corresponding at least one of (i) the at least one attachment point of the middle section of the backboard, and (ii) the at least one securing structure of the back plate;

wherein the locking structure-engaging areas are openings and the locking structures are opening-engaging structures; and wherein the body portions of the bottom segment and at least one middle segment include four rows of openings, wherein each of the rows has the same number of openings and each opening in one of the four rows has a corresponding opening in each of the remaining three rows, thereby forming sets of openings each containing four openings wherein each of the four openings of a set of openings is at the same height.

19. The portable basketball hoop of claim 18, wherein a first of the openings in each set of four openings has a corresponding second opening which is coaxial with the first opening, and wherein a third opening in each set of four openings has a corresponding fourth opening which is coaxial with the third opening.

20. A portable basketball hoop comprising:

a hemispherical base having a bottom surface with a perimeter, a plurality of weight-receiving openings circumferentially positioned and equally spaced around at least a portion ⅔ of the perimeter adjacent to the bottom surface, and an upper surface with a centrally-located opening;

a post comprising:

a bottom segment having a bottom portion which engages the hemispherical base at the opening of the upper surface, and a body portion, at least one middle segment having a body portion, an upper segment having an upper portion having a back plate, wherein the back plate includes at least one securing structure, a backboard comprising two outer sections hingedly connected to a middle section, the two outer sections and middle section each having a front surface, wherein the two outer sections are hingedly moveable relative to the middle section such that the backboard has an open position and a folded position, wherein the front surfaces of the two outer sections and middle section are coplanar the backboard is in the open position, and wherein the middle section includes at least one attachment point corresponding to the at least one securing structure of the back plate; and a rim comprising at least one attachment point corresponding at least one of (i) the at least one attachment point of the middle section of the backboard, and (ii) the at least one securing structure of the back plate;

wherein the back plate comprises a plurality of securing structures, wherein the middle section of the backboard comprises a plurality of attachment points, wherein at least one of the attachment points corresponds to at least one of the pluralities of securing structures of the back plate, and wherein the rim comprises at least two attachment points wherein at least one of (i) the at least two attachment points correspond to at least two of the plurality of attachment points of the middle section of the backboard other than the at least one attachment points of the middle section of the backboard corresponding to the at least one of the plurality of securing structures of the back plate, or (ii) at least two of the plurality of attachment points of the middle section of the backboard correspond to at least two of the plurality of securing structures of the back plate and the at least two attachment points of the rim correspond to the at least two of the plurality of attachment points of the middle section and the at least two of the plurality of securing structures of the back plate.

* * * * *